US007860710B2

(12) United States Patent
Goudar et al.

(10) Patent No.: US 7,860,710 B2
(45) Date of Patent: Dec. 28, 2010

(54) METHODS, DEVICES AND SYSTEMS FOR IMPROVED CODEBOOK SEARCH FOR VOICE CODECS

(75) Inventors: Chanaveeragouda V. Goudar, Bangalore (IN); Murali M. Deshpande, Bangalore (IN); Pankaj Rabha, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 1409 days.

(21) Appl. No.: 11/231,643

(22) Filed: Sep. 21, 2005

(65) Prior Publication Data

US 2006/0074641 A1 Apr. 6, 2006

Related U.S. Application Data

(60) Provisional application No. 60/612,497, filed on Sep. 22, 2004, provisional application No. 60/612,494, filed on Sep. 22, 2004.

(51) Int. Cl.
*G10L 19/00* (2006.01)
*G10L 19/12* (2006.01)

(52) U.S. Cl. ..... 704/219; 704/221

(58) Field of Classification Search ..... 704/219–223
See application file for complete search history.

(56) References Cited

U.S. PATENT DOCUMENTS 6,073,092 A 6/2000 Kwon
6,556,966 B1 4/2003 Gao
6,766,289 B2 7/2004 Kandhadai et al.
6,789,059 B2 * 9/2004 Kandhadai et al. ..... 704/216
2001/0053972 A1 12/2001 Amada et al.
2002/0007269 A1 1/2002 Gao
2002/0095284 A1 7/2002 Gao
2002/0103638 A1 8/2002 Gao
2003/0033136 A1 * 2/2003 Lee ..... 704/2

(Continued)

OTHER PUBLICATIONS

3GPP2, "Selectable Mode Vocoder Service Option for Wideband Spread Spectrum Communication Systems," Dec. 2001, C.S0030-0, Version 2,0, pp. 3-4, 13-14, 61,143-145, 159-178, Figs. 5.3-1 and 5.6-1,2.*

(Continued)

*Primary Examiner*—Angela A Armstrong
(74) *Attorney, Agent, or Firm*—Wade J. Brady, III; Frederick J. Telecky, Jr.

(57) ABSTRACT

An electronic circuit (1100) including a processor circuit (1110) and a storage circuit establishing a speech coder (1170) for execution by said processor (1110), the speech coder (1170) for approximating speech by pulses having pulse positions selectable from a codebook (550), the speech coder (1170) operable to obtain (1310) a set of estimated pulse positions having a first number of pulse tracks of the estimated pulse positions, use (1320) a cost function (epsilon tilde $\tilde{\epsilon}$) relating to approximation to speech to find a first subset including a second number of one or more pulse tracks fewer in number than the first number wherein the first subset of pulse tracks contributed a lower contribution to the cost function relative to a second subset of pulse tracks, and control (1330) a subsequent pulse position search beginning with the lower-contributing subset of pulse tracks to yield pulse positions to provide a value of the cost function representing a better approximation to speech. Other forms of the invention involve systems, circuits, devices, processes and processes of operation, as disclosed and claimed.

31 Claims, 11 Drawing Sheets

U.S. PATENT DOCUMENTS

2003/0078771 A1 4/2003 Jung et al.
2003/0097258 A1 5/2003 Thyssen
2003/0200092 A1 10/2003 Gao et al.
2004/0098254 A1 5/2004 Lee et al.
2004/0181400 A1 * 9/2004 Kannan et al. ..... 704/223

OTHER PUBLICATIONS

Baron, "Five Chips From TI—Or, Is It Six!" Microprocessor Report, Instat-MDR, Mar. 17, 2003, Figs. 1, 3, 4.

* cited by examiner

*FIG. 5*

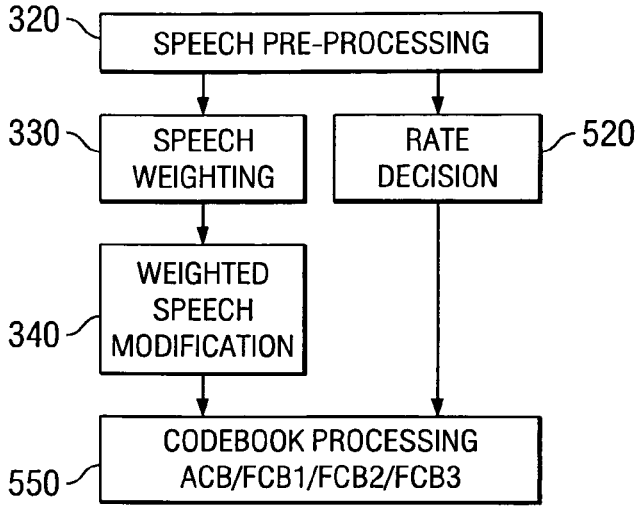

*FIG. 6*

ERROR FUNCTION:

TARGET SIGNAL — FILTER MATRIX $$\varepsilon = ||Tg - g[H]\vec{c}||^2$$

GAIN — EXCITATION VECTOR $$\vec{c}_i = c^{-} + p_i = \begin{bmatrix} \sim \\ \sim \\ \sim \\ \cdot \\ \cdot \\ \cdot \\ \sim \\ 0 \\ \sim \\ \sim \end{bmatrix} + \begin{bmatrix} 0 \\ 0 \\ 0 \\ \cdot \\ \cdot \\ \cdot \\ 0 \\ 1 \\ 0 \\ 0 \end{bmatrix} \leftarrow \text{PULSE}$$

COST FUNCTION: $\tilde{\varepsilon} \nearrow$ AS $\varepsilon \searrow$ $$\tilde{\varepsilon} = \frac{[(T_g^T H)c]^2}{(Hc)^T Hc}$$

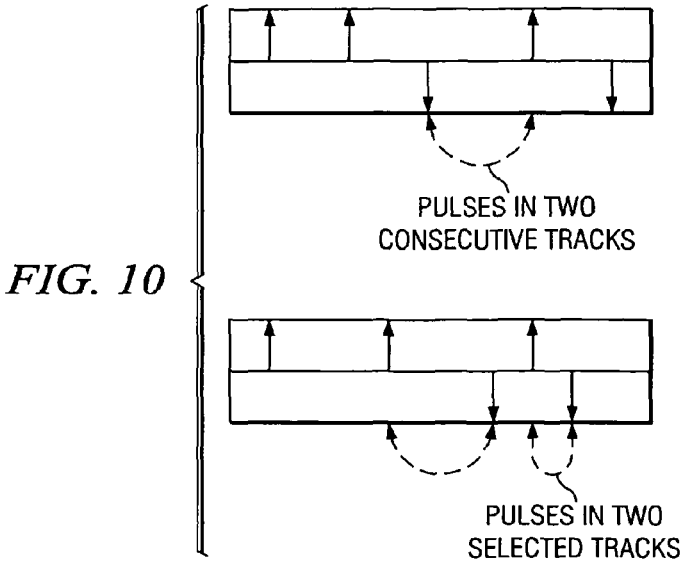
FIG. 10
FIG. 11A
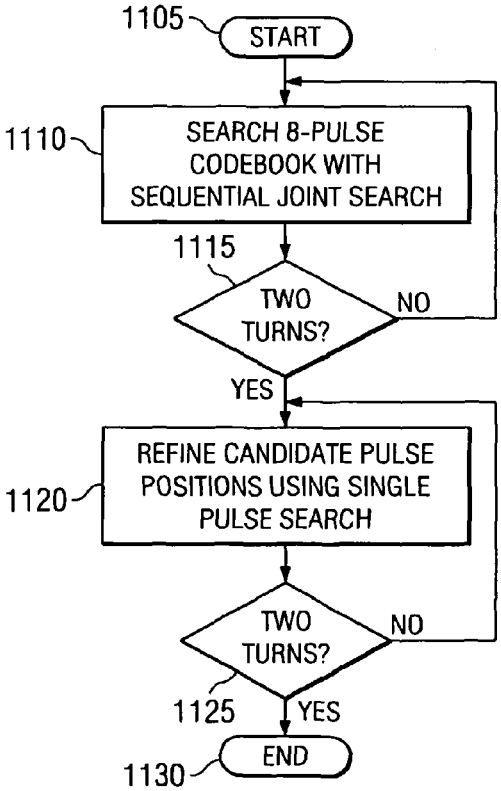
FIG. 11B
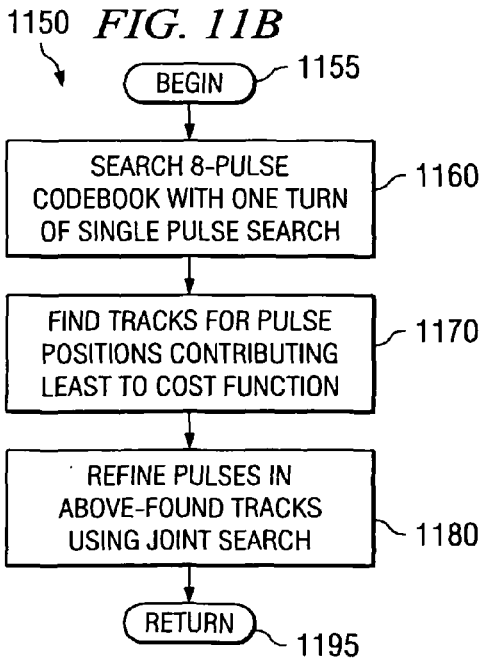

METHODS, DEVICES AND SYSTEMS FOR IMPROVED CODEBOOK SEARCH FOR VOICE CODECS

CROSS-REFERENCE TO RELATED APPLICATIONS

This application is related to provisional U.S. Patent Application Ser. No. 60/612,497, (TI-38348PS) filed Sep. 22, 2004, titled "Methods, Devices and Systems for Improved Codebook Search for Voice Codecs," for which priority under 35 U.S.C. 119(e)(1) is hereby claimed and which is hereby incorporated herein by reference.

This application is related to provisional U.S. Patent Application Ser. No. 60/612,494, (TI-38349PS) filed Sep. 22, 2004, titled "Methods, Devices and Systems for Improved Pitch Enhancement in Voice Codecs," for which priority under 35 U.S.C. 119(e)(1) is hereby claimed and which is hereby incorporated herein by reference.

This application is co-filed so that the present U.S. non-provisional patent application TI-38348 "Methods, Devices and Systems for Improved Codebook Search for Voice Codecs" Ser. No. 11/231,643 and the present U.S. non-provisional patent application TI-38349 "Methods, Devices and Systems for Improved Pitch Enhancement and Autocorrelation in Voice Codecs" Ser. No. 11/231,686 each have the same application filing date, and each of said patent applications hereby incorporates the other by reference.

STATEMENT REGARDING FEDERALLY SPONSORED RESEARCH OR DEVELOPMENT

Not applicable.

BACKGROUND OF THE INVENTION

This invention is in the field of information and communications, and is more specifically directed to improved processes, circuits, devices, and systems for information and communication processing, and processes of operating and making them. Without limitation, the background is further described in connection with wireless and wireline communications processing.

Wireless and wireline communications of many types have gained increasing popularity in recent years. The mobile wireless (or "cellular") telephone has become ubiquitous around the world. Mobile telephony has recently begun to communicate video and digital data, in addition to voice. Wireless devices, for communicating computer data over a wide area network, using mobile wireless telephone channels and techniques are also available. Wireline communications such as DSL and cable modems and wireline and wireless gateways to other networks are proliferating.

The market for portable devices such as cell phones and PDAs (personal digital assistants) is expanding with many more features and applications. More features and applications call for microprocessors to have high performance but with low power consumption. Thus, keeping the power consumption for the microprocessor and related cores and chips to a minimum, given a set of performance requirements, is very important. In both the wireless and wireline areas, high efficiency of performance and in operational processes is essential to make affordable products available to a wider public.

Voice over Packet (VoP) communications are further expanding the options and user convenience in telephonic communications. An example is Voice over Internet Protocol (VoIP) enabling phone calls over the Internet.

Wireless and wireline data communications using wireless local area networks (WLAN), such as IEEE 802.11 compliant, have become especially popular in a wide range of installations, ranging from home networks to commercial establishments. Other wireless networks such as IEEE 802.16 (WiMax) are emerging. Short-range wireless data communication according to the "Bluetooth" and other IEEE 802.15 technology permits computer peripherals to communicate with a personal computer or workstation within the same room.

Security is important in both wireline and wireless communications for improved security of retail and other business commercial transactions in electronic commerce and wherever personal and/or commercial privacy is desirable. Added features and security add further processing tasks to the communications system. These portend added software and hardware in systems where affordability and power dissipation are already important concerns.

In very general terms, a speech coder or voice coder is based on the idea that the vocal chords and vocal tract are analogous to a filter. The vocal chords and vocal tract generally make a variety of sounds. Some sounds are voiced and generally have a pitch level or levels at a given time. Other sounds are unvoiced and have a rushing or whispering or sudden consonantal sound to them. To facilitate the voice coding process, voice sounds are converted into an electrical waveform by a microphone and analog to digital converter. The electrical waveform is conceptually cut up into successive frames of a few milliseconds in duration called a target signal. The frames are individually approximated by the voice coder electronics.

In speech or voice coder electronics, pulses can be provided at different times to excite a filter. Each pulse has a very wide spectrum of frequencies which are comprised in the pulse. The filter selects some of the frequencies such as by passing only a band of frequencies, thus the term bandpass filter. Circuits and/or processes that provide various pulses, more or less filtered, excite the filter to supply as its output an approximation to the voice sounds of a target signal. Finding the appropriate pulses to use for the excitation pulses for the voice coder approximation purposes is involved in the subject of codebook search herein.

The filter(s) are characterized by a set of numbers called coefficients that, for example, may represent the impulse response over time when a filter is excited with a single pulse. Information identifying the appropriate pulses, and the values of the filter coefficients, and such other information as is desired, together compactly represent the speech in a given frame. The information is generated as bits of data by a processor chip that runs software or otherwise operates according to a speech coding procedure. Generally speaking, the output of a voice coder is this very compact representation which advantageously substitutes in communication for the vastly larger number of bits that would be needed to directly send over a communications network the voice signal converted into digital form at the output of the analog to digital converter were there no speech coding.

A speech or voice decoder is a coder in reverse in the sense that the decoder responds to the compact information sent over a network from a coder and produces a digital signal representing speech that can be converted by a digital-to-analog converter into an analog signal to produce actual sound in a loudspeaker or earphone.

Voice coders and decoders (codecs) run on RISC (Reduced. Instruction Set Computing) processors and digital signal processing (DSP) chips and/or other integrated circuit devices that are vital to these systems and applications. Reducing the computer burden of voice codecs and increasing the efficiency of executing the software applications on these microprocessors generally are very important to achieve system performance and affordability goals and operate within power dissipation and battery life limits. These goals become even more important in hand held and mobile applications where small size is so important, to control the real-estate, memory space and the power consumed.

In the description herein, the term "Cost function" is used to refer to a degree of approximation for improving and increasing voice coding quality. The term "Cost function" is not herein referring to financial or monetary expense nor to technological complexity, any of which can be reduced by the improvements herein even though the Cost function is increased.

SUMMARY OF THE INVENTION

Generally, a form of the invention involves an electronic circuit including a processor circuit and a storage circuit establishing a speech coder for execution by said processor, the speech coder for approximating speech by pulses having pulse positions selectable from a codebook. The speech coder is operable to obtain a set of estimated pulse positions having a first number of pulse tracks of the estimated pulse positions, use a cost function relating to approximation to speech to find a first subset including a second number of one or more pulse tracks fewer in number than the first number wherein the first subset of pulse tracks contributed a lower contribution to the cost function relative to a second subset of pulse tracks, and control a subsequent pulse position search beginning with the lower-contributing subset of pulse tracks to yield second pulse positions to provide a value of the cost function representing a better approximation to speech.

Generally, another form of the invention involves a process of codebook search in speech coding for approximating speech by pulses having pulse positions selectable from a codebook. The process of codebook search includes obtaining a set of estimated pulse positions having a first number of pulse tracks of the estimated pulse positions, using a cost function relating to approximation to speech to find a first subset including a second number of one or more pulse tracks fewer in number than the first number wherein the first subset of pulse tracks contributed a lower contribution to the cost function relative to a second subset of pulse tracks, and controlling a subsequent pulse position search beginning with the lower-contributing subset of pulse tracks to yield pulse positions to provide a value of the cost function representing a better approximation to speech.

Other forms of the invention involve systems, circuits, devices, processes and methods of operation, as disclosed and claimed.

BRIEF DESCRIPTION OF THE DRAWINGS

FIG. 5 is a process block diagram of SMV as example platform for inventive improvements to codebook searching as taught herein resulting in an inventive vocoder for the systems, devices and processes of FIGS. 1-4.

FIG. 6 is an illustration of a symbolic representation of data structures in which a target signal, filter, excitation, and pulses are used in the inventive improvements to the processes of FIGS. 3-6.

FIG. 10 is a composite diagram of pulses in tracks for illustrating an inventive Sequential Joint Search procedure for finding or determining excitation pulses in FIGS. 3-7.

FIG. 11A is a flow diagram of a standard SMV method of searching for pulses for Rate 1, voiced-stationary (Type 1) frames.

FIG. 11B is a flow diagram of an inventive method of finding or determining excitation pulses in FIGS. 3-7 for Rate 1, voiced-stationary (Type 1) frames.

Corresponding numerals ordinarily identify corresponding parts in the various Figures of the drawing except where the context indicates otherwise.

DETAILED DESCRIPTION

Figure 1:
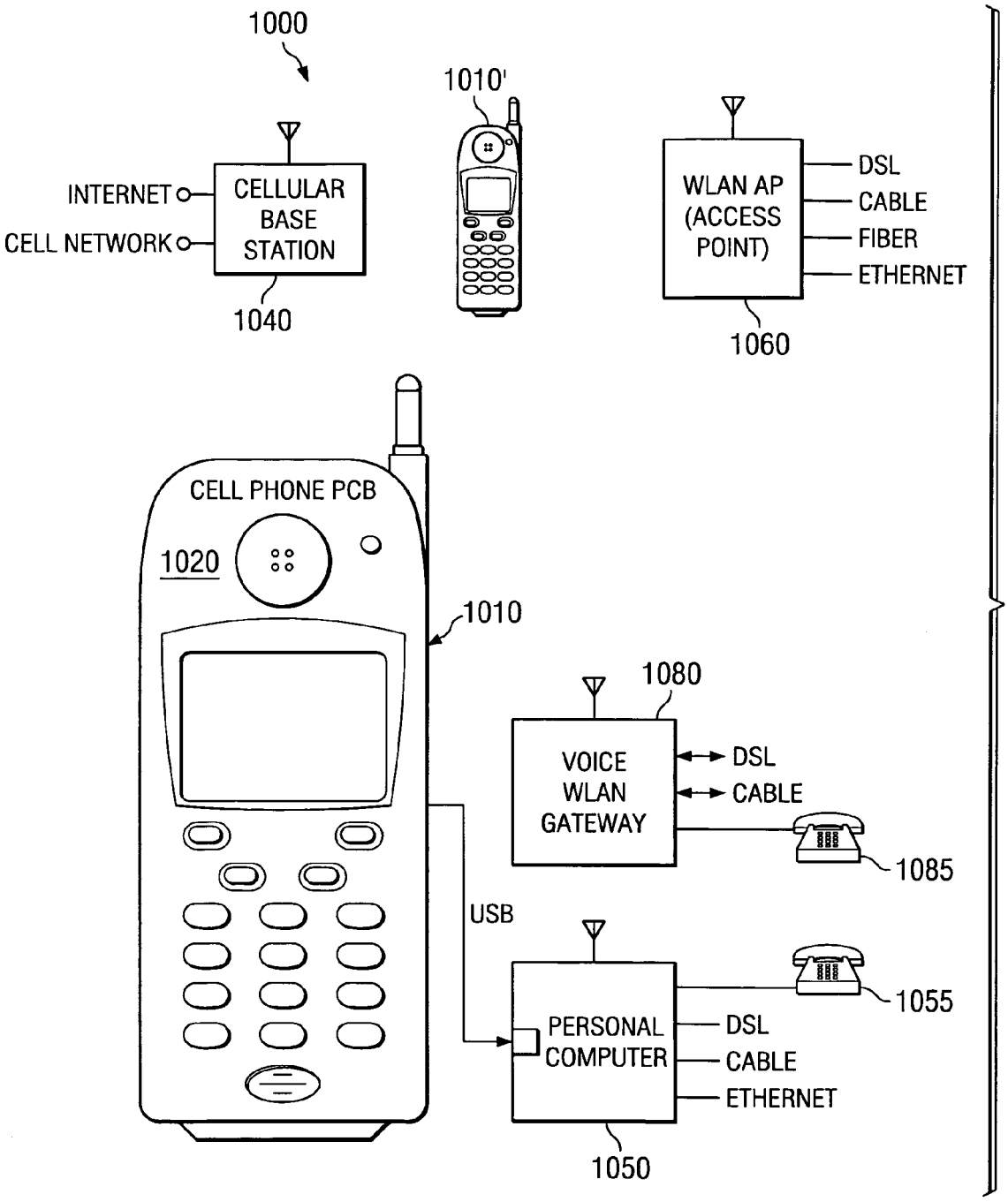
FIG. 1 is a pictorial diagram of a communications system including a cellular base station, two cellular telephone handsets, a WLAN AP (wireless local area network access point), a WLAN gateway with VoP phone, a personal computer (PC) with VoP phone, a WLAN station on the PC, and any one, some or all of the foregoing improved according to the invention.

In FIG. 1, an improved communications system 1000 has system blocks as described next. Any or all of the system blocks, such as cellular mobile telephone and data handsets 1010 and 1010', a cellular (telephony and data) base station 1040, a WLAN AP (wireless local area network access point, IEEE 802.11 or otherwise) 1060, a Voice WLAN gateway 1080 with user voice over packet telephone 1085, and a voice enabled personal computer (PC) 1050 with another user voice over packet telephone 1055, communicate with each other in communications system 1000. Each of the system blocks 1010, 1010', 1040, 1050, 1060, 1080 are provided with one or more PHY physical layer blocks and interfaces as selected by the skilled worker in various products, for DSL (digital subscriber line broadband over twisted pair copper infrastructure), cable (DOCSIS and other forms of coaxial cable broadband communications), premises power wiring, fiber (fiber optic cable to premises), and Ethernet wideband network. Cellular base station 1040 two-way communicates with the handsets 1010, 1010', with the Internet, with cellular communications networks and with PSTN (public switched telephone network).

In this way, advanced networking capability for services, software, and content, such as cellular telephony and data, audio, music, voice, video, e-mail, gaming, security, e-commerce, file transfer and other data services, internet, world wide web browsing, TCP/IP (transmission control protocol/Internet protocol), voice over packet and voice over Internet protocol (VoP/VoIP), and other services accommodates and provides security for secure utilization and entertainment appropriate to the just-listed and other particular applications.

The embodiments, applications and system blocks disclosed herein are suitably implemented in fixed, portable, mobile, automotive, seaborne, and airborne, communications, control, set top box, and other apparatus. The personal computer (PC) 1050 is suitably implemented in any form factor such as desktop, laptop, palmtop, organizer, mobile phone handset, PDA personal digital assistant, internet appliance, wearable computer, personal area network, or other type.

Figure 2:
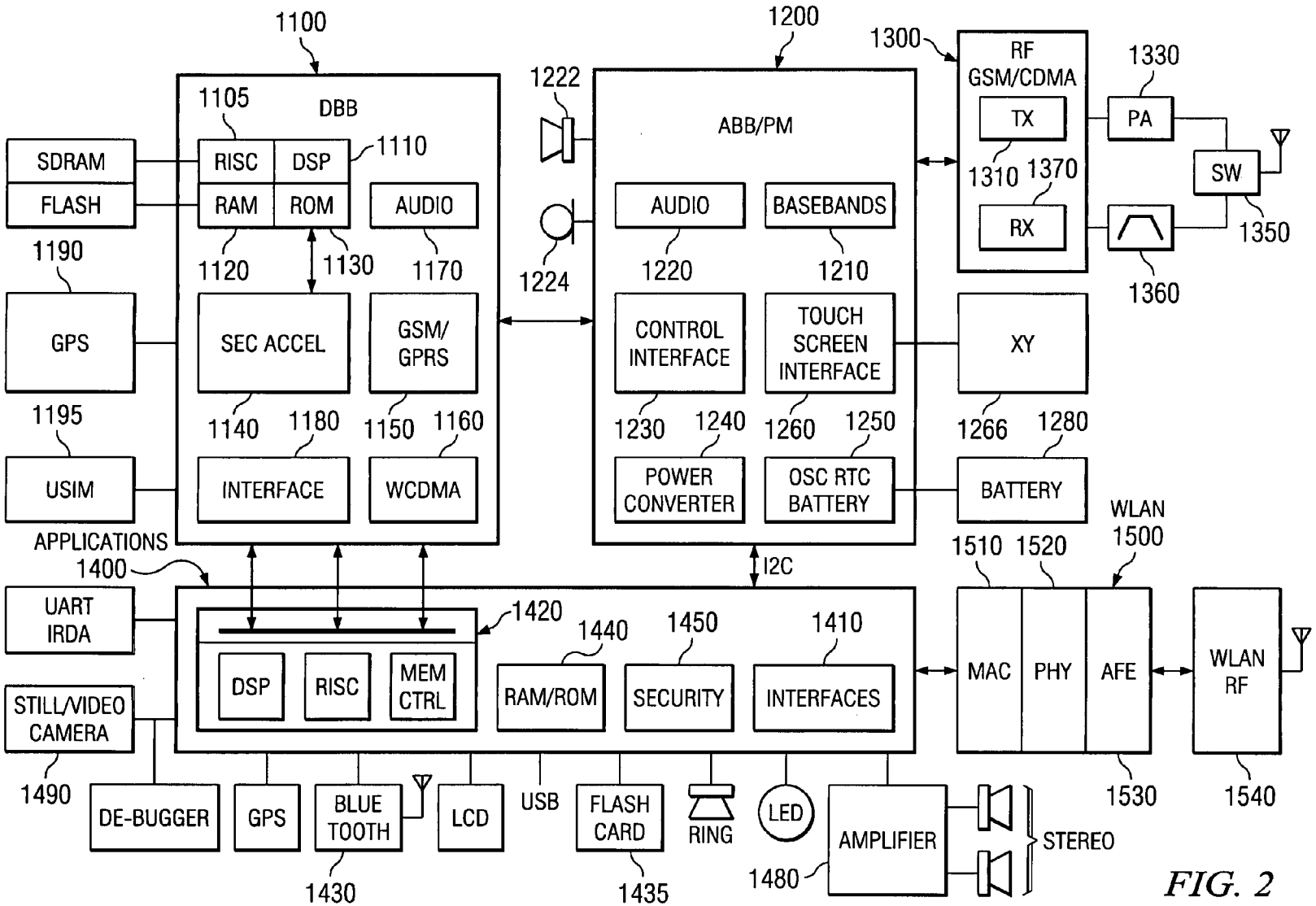
FIG. 2 is a block diagram of an inventive integrated circuit chip device with any subset or all of the chip circuits for use in the blocks of the communications system of FIG. 1 and improved according to the invention.

For example, handset 1010 is improved and remains interoperable and able to communicate with all other similarly improved and unimproved system blocks of communications system 1000. On a cell phone printed circuit board (PCB) 1020 in handset 1010, FIGS. 1 and 2 show a processor integrated circuit and a serial interface such as a USB interface connected by a USB line to the personal computer 1050. Reception of software, intercommunication and updating of information are provided between the personal computer 1050 (or other originating sources external to the handset 1010) and the handset 1010. Such intercommunication and updating also occur automatically and/or on request via WLAN, Bluetooth, or other wireless circuitry.

FIG. 2 illustrates inventive integrated circuit chips including chips 1100, 1200, 1300, 1400, 1500 for use in the blocks of the communications system 1000 of FIG. 1. The skilled worker uses and adapts the integrated circuits to the particular parts of the communications system 1000 as appropriate to the functions intended. For conciseness of description, the integrated circuits are described with particular reference to use of all of them in the cellular telephone handsets 1010 and 1010' by way of example.

It is contemplated that the skilled worker uses each of the integrated circuits shown in FIG. 2, or such selection from the complement of blocks therein provided into appropriate other integrated circuit chips, or provided into one single integrated circuit chip, in a manner optimally combined or partitioned between the chips, to the extent needed by any of the applications supported by the cellular telephone base station 1040, personal computer(s) 1050 equipped with WLAN, WLAN access point 1060 and Voice WLAN gateway 1080, as well as cellular telephones, radios and televisions, fixed and portable entertainment units, routers, pagers, personal digital assistants (PDA), organizers, scanners, faxes, copiers, household appliances, office appliances, combinations thereof, and other application products now known or hereafter devised in which there is desired increased, partitioned or selectively determinable advantages next described.

In FIG. 2, an integrated circuit 1100 includes a digital baseband (DBB) block 1110 that has a RISC processor (such as MIPS core, ARM processor, or other suitable processor) and a digital signal processor (or DSP core) 1110, communications software and security software for any such processor or core, security accelerators 1140, and a memory controller. The memory controller interfaces the RISC core and the DSP core to Flash memory and SDRAM (synchronous dynamic random access memory). The memories are improved by any one or more of the processes herein. On chip RAM 1120 and on-chip ROM 1130 also are accessible to the processors 1110 for providing sequences of software instructions and data thereto.

Digital circuitry 1150 on integrated circuit 1100 supports and provides wireless interfaces for any one or more of GSM, GPRS, EDGE, UMTS, and OFDMA/MIMO (Global System for Mobile communications, General Packet Radio Service, Enhanced Data Rates for Global Evolution, Universal Mobile Telecommunications System, Orthogonal Frequency Division Multiple Access and Multiple Input Multiple Output Antennas) wireless, with or without high speed digital data service, via an analog baseband chip 1200 and GSM transmit/receive chip 1300. Digital circuitry 1150 includes ciphering processor CRYPT for GSM ciphering and/or other encryption/decryption purposes. Blocks TPU (Time Processing Unit real-time sequencer), TSP (Time Serial Port), GEA (GPRS Encryption Algorithm block for ciphering at LLC logical link layer), RIF (Radio Interface), and SPI (Serial Port Interface) are included in digital circuitry 1150.

Digital circuitry 1160 provides codec for CDMA (Code Division Multiple Access), CDMA 2000, and/or WCDMA (wideband CDMA or UMTS) wireless with or without an HSDPA/HSUPA (High Speed Downlink Packet Access, High Speed Uplink Packet Access) (or 1xEV-DV, 1xEV-DO or 3xEV-DV) data feature via the analog baseband chip 1200 and an RF GSM/CDMA chip 1300. Digital circuitry 1160 includes blocks MRC (maximal ratio combiner for multipath symbol combining), ENC (encryption/decryption), RX (downlink receive channel decoding, de-interleaving, viterbi decoding and turbo decoding) and TX (uplink transmit convolutional encoding, turbo encoding, interleaving and channelizing.). Block ENC has blocks for uplink and downlink supporting confidentiality processes of WCDMA.

Audio/voice block 1170 supports audio and voice functions and interfacing. Speech/voice codec(s) are suitably provided in memory space in audio/voice block 1170 for processing by processor(s) 1110. Applications interface block 1180 couples the digital baseband chip 1100 to an applications processor 1400. Also, a serial interface in block 1180 interfaces from parallel digital busses on chip 1100 to USB (Universal Serial Bus) of PC (personal computer) 1050. The serial interface includes UARTs (universal asynchronous receiver/transmitter circuit) for performing the conversion of data between parallel and serial lines. Chip 1100 is coupled to location-determining circuitry 1190 for GPS (Global Positioning System). Chip 1100 is also coupled to a USIM (UMTS Subscriber Identity Module) 1195 or other SIM for user insertion of an identifying plastic card, or other storage element, or for sensing biometric information to identify the user and activate features.

In FIG. 2, a mixed-signal integrated circuit 1200 includes an analog baseband (ABB) block 1210 for GSM/GPRS/EDGE/UMTS/HSDPA which includes SPI (Serial Port Interface), digital-to-analog/analog-to-digital conversion DAC/

ADC block, and RF (radio frequency) Control pertaining to GSM/GPRS/EDGE/UMTS and coupled to RF (GSM etc.) chip 1300. Block 1210 suitably provides an analogous ABB for CDMA wireless and any associated 1xEV-DV, 1xEV-DO or 3xEV-DV data and/or voice with its respective SPI (Serial Port Interface), digital-to-analog conversion DAC/ADC block, and RF Control pertaining to CDMA and coupled to RF (CDMA) chip 1300.

An audio block 1220 has audio I/O (input/output) circuits to a speaker 1222, a microphone 1224, and headphones (not shown). Audio block 1220 has an analog-to-digital converter (ADC) coupled to the voice codec and a stereo DAC (digital to analog converter) for a signal path to the baseband block 1210 including audio/voice block 1170, and with suitable encryption/decryption activated or not.

A control interface 1230 has a primary host interface (I/F) and a secondary host interface to DBB-related integrated circuit 1100 of FIG. 2 for the respective GSM and CDMA paths. The integrated circuit 1200 is also interfaced to an I2C port of applications processor chip 1400 of FIG. 2. Control interface 1230 is also coupled via access arbitration circuitry to the interfaces in circuits 1250 and the baseband 1210.

A power conversion block 1240 includes buck voltage conversion circuitry for DC-to-DC conversion, and low-dropout (LDO) voltage regulators for power management/sleep mode of respective parts of the chip regulated by the LDOs. Power conversion block 1240 provides information to and is responsive to a power control state machine shown between the power conversion block 1240 and circuits 1250.

Circuits 1250 provide oscillator circuitry for clocking chip 1200. The oscillators have frequencies determined by one or more crystals. Circuits 1250 include a RTC real time clock (time/date functions), general purpose I/O, a vibrator drive (supplement to cell phone ringing features), and a USB On-The-Go (OTG) transceiver. A touch screen interface 1260 is coupled to a touch screen XY 1266 off-chip.

Batteries such as a lithium-ion battery 1280 and backup battery provide power to the system and battery data to circuit 1250 on suitably provided separate lines from the battery pack. When needed, the battery 1280 also receives charging current from a Battery Charge Controller in analog circuit 1250 which includes MADC (Monitoring ADC and analog input multiplexer such as for on-chip charging voltage and current, and battery voltage lines, and off-chip battery voltage, current, temperature) under control of the power control state machine.

In FIG. 2 an RF integrated circuit 1300 includes a GSM/GPRS/EDGE/UMTS/CDMA RF transmitter block 1310 supported by oscillator circuitry with off-chip crystal (not shown). Transmitter block 1310 is fed by baseband block 1210 of chip 1200. Transmitter block 1310 drives a dual band RF power amplifier (PA) 1330. On-chip voltage regulators maintain appropriate voltage under conditions of varying power usage. Off-chip switchplexer 1350 couples wireless antenna and switch circuitry to both the transmit portion 1310, 1330 and the receive portion next described. Switchplexer 1350 is coupled via band-pass filters 1360 to receiving LNAs (low noise amplifiers) for 850/900 MHz, 1800 MHz, 1900 MHz and other frequency bands as appropriate. Depending on the band in use, the output of LNAs couples to GSM/GPRS/EDGE/UMTS/CDMA demodulator 1370 to produce the I/Q or other outputs thereof (in-phase, quadrature) to the GSM/GPRS/EDGE/UMTS/CDMA baseband block 1210.

Further in FIG. 2, an integrated circuit chip or core 1400 is provided for applications processing and more off-chip peripherals. Chip (or core) 1400 has interface circuit 1410 including a high-speed WLAN 802.11a/b/g interface coupled to a WLAN chip 1500. Further provided on chip 1400 is an applications processing section 1420 which includes a RISC processor (such as MIPS core, ARM processor, or other suitable processor), a digital signal processor (DSP), and a shared memory controller MEM CTRL with DMA (direct memory access), and a 2D (two-dimensional display) graphic accelerator. Speech/voice codec functionality is suitably processed in chip 1400, in chip 1100, or both chips 1400 and 1100.

The RISC processor and the DSP in section 1420 have access via an on-chip extended memory interface (EMIF/CF) to off-chip memory resources 1435 including as appropriate, mobile DDR (double data rate) DRAM, and flash memory of any of NAND Flash, NOR Flash, and Compact Flash. On chip 1400, the shared memory controller in circuitry 1420 interfaces the RISC processor and the DSP via an on-chip bus to on-chip memory 1440 with RAM and ROM. A 2D graphic accelerator is coupled to frame buffer internal SRAM (static random access memory) in block 1440. A security block 1450 includes secure hardware accelerators having security features and provided for accelerating encryption and decryption of any one or more types known in the art or hereafter devised.

On-chip peripherals and additional interfaces 1410 include UART data interface and MCSI (Multi-Channel Serial Interface) voice wireless interface for an off-chip IEEE 802.15 ("Bluetooth" and high and low rate piconet and personal network communications) wireless circuit 1430. Debug messaging and serial interfacing are also available through the UART. A JTAG emulation interface couples to an off-chip emulator Debugger for test and debug. Further in peripherals 1410 are an I2C interface to analog baseband ABB chip 1200, and an interface to applications interface 1180 of integrated circuit chip 1100 having digital baseband DBB.

Interface 1410 includes a MCSI voice interface, a UART interface for controls, and a multi-channel buffered serial port (McBSP) for data. Timers, interrupt controller, and RTC (real time clock) circuitry are provided in chip 1400. Further in peripherals 1410 are a MicroWire (u-wire 4 channel serial port) and multi-channel buffered serial port (McBSP) to off-chip Audio codec, a touch-screen controller, and audio amplifier 1480 to stereo speakers. External audio content and touch screen (in/out) and LCD (liquid crystal display) are suitably provided. Additionally, an on-chip USB OTG interface couples to off-chip Host and Client devices. These USB communications are suitably directed outside handset 1010 such as to PC 1050 (personal computer) and/or from PC 1050 to update the handset 1010.

An on-chip UART/IrDA (infrared data) interface in interfaces 1410 couples to off-chip GPS (global positioning system) and Fast IrDA infrared wireless communications device. An interface provides EMT9 and Camera interfacing to one or more off-chip still cameras or video cameras 1490, and/or to a CMOS sensor of radiant energy. Such cameras and other apparatus all have additional processing performed with greater speed and efficiency in the cameras and apparatus and in mobile devices coupled to them with improvements as described herein. Further in FIG. 2, an on-chip LCD controller and associated PWL (Pulse-Width Light) block in interfaces 1410 are coupled to a color LCD display and its LCD light controller off-chip.

Further, on-chip interfaces 1410 are respectively provided for off-chip keypad and GPIO (general purpose input/output). On-chip LPG (LED Pulse Generator) and PWT (Pulse-Width Tone) interfaces are respectively provided for off-chip LED and buzzer peripherals. On-chip MMC/SD multimedia and flash interfaces are provided for off-chip MMC Flash card, SD flash card and SDIO peripherals.

In FIG. 2, a WLAN integrated circuit 1500 includes MAC (media access controller) 1510, PHY (physical layer) 1520 and AFE (analog front end) 1530 for use in various WLAN and UMA (Unlicensed Mobile Access) modem applications. PHY 1520 includes blocks for BARKER coding, CCK, and OFDM. PHY 1520 receives PHY Clocks from a clock generation block supplied with suitable off-chip host clock, such as at 13, 16.8, 19.2, 26, or 38.4 MHz. These clocks are compatible with cell phone systems and the host application is suitably a cell phone or any other end-application. AFE 1530 is coupled by receive (Rx), transmit (Tx) and CONTROL lines to WLAN RF circuitry 1540. WLAN RF 1540 includes a 2.4 GHz (and/or 5 GHz) direct conversion transceiver, or otherwise, and power amplifer and has low noise amplifier LNA in the receive path. Bandpass filtering couples WLAN RF 1540 to a WLAN antenna. In MAC 1510, Security circuitry supports any one or more of various encryption/decryption processes such as WEP (Wired Equivalent Privacy), RC4, TKIP, CKIP, WPA, AES (advanced encryption standard), 802.11i and others. Further in WLAN 1500, a processor comprised of an embedded CPU (central processing unit) is connected to internal RAM and ROM and coupled to provide QoS (Quality of Service) IEEE 802.11e operations WME, WSM, and PCF (packet control function). A security block in WLAN 1500 has busing for data in, data out, and controls interconnected with the CPU. Interface hardware and internal RAM in WLAN 1500 couples the CPU with interface 1410 of applications processor integrated circuit 1400 thereby providing an additional wireless interface for the system of FIG. 2. Still other additional wireless interfaces such as for wideband wireless such as IEEE 802.16 "WiMAX" mesh networking and other standards are suitably provided and coupled to the applications processor integrated circuit 1400 and other processors in the system.

Further described next are the improved voice codecs structures and processes and improving the systems and devices of FIGS. 1 and 2 with them. In the subsequent Figures, Selectable Mode Vocoder (SMV standard of 3GPP2 organization) is used without limitation as an example platform for improvements. It is emphasized that the improvements are generally applicable in voice codec search procedures and all other search procedures to which the advantages of the improvements herein commend their use. ACELP-based FCB searches (Algebraic Code Excited Linear Prediction Fixed CodeBook search procedures) are suitably improved by the inventive structures and processes taught herein. As discussed later hereinbelow, these include GSM AMR, WB-AMR, EFR, EVRC and others.

SMV (Selectable Mode Vocoder) is a CELP (Code Excited Linear Prediction) based speech coding standard from 3GPP2 organization. The quality of the speech attained by SMV and its multimodal operation capability makes it quite suitable for wireless mobile communication.

The multi-mode feature of SMV varies the Rate and trades off channel bandwidth and voice quality as the Rate is changed. Applications include voice gateways and 3G third generation and higher generation cell phone handsets. Minimum performance specifications are defined for SMV by subjective and objective comparison with respect to a floating point reference. SMV speech quality is ordinarily expected to be better than EVRC (Enhanced Variable Rate Codec)(TIA IS-127) at the same average data rate (mode 0) and equivalent to EVRC at a lower data rate (mode 1). The complexity of SMV in MIPS (millions of instructions per second) is the highest among CDMA speech codecs.

SMV processing involves frame processing and rate-dependent excitation coding. The frame processing includes speech pre-processing, computation of spectral Envelope Parameters, signal modification, and rate selection. The SMV encoder frame processing which includes speech pre-processing, LPC analysis, signal modification and LSF quantization has complexity of about 50% or half the complexity of the SMV encoder. The rate-dependent excitation coding involves an adaptive codebook search, a fixed codebook search with complexity of about 40% that of the encoder in the worst case, and gain quantization. Overall, the SMV encoder rate-dependent excitation coding is about 50% or half of the complexity of the SMV encoder.

The computational complexity of the SMV speech codec is higher than other CDMA speech codecs. A significant portion of the computational complexity in the SMV speech codec can be attributed to the fixed codebook search that is done using multiple codebooks. Some embodiments of fixed codebook search procedure for improving SMV and other voice coding processes are based on a special approach called Selective Joint Search herein.

SMV encodes each 20 millisecond speech frame at one of four different bit rates: full-rate (1), half-rate (½), quarter-rate (¼) and one-eighth-rate (⅛). The bit rate chosen depends on the mode of operation and the type of speech signal.

Frames assigned to full-rate (Rate 1) are further classified as Voiced-Stationary (Type 1) and Voiced-Non-Stationary (Type 0). Each of these two classes is associated with one or more "fixed codebooks" (FCB). Each fixed codebook consists of pulse combinations. One important step in the process of encoding speech is choosing the best pulse combination from a codebook. The best combination is the one that results in the lowest value of an error function and the highest value for a Cost function (herein referring to a data structure or function having a value that goes up as the error function goes down) among the pulse combinations that are searched. The Cost function increases with the goodness of fit, or goodness of approximation of the coded speech to the real speech being coded. Thus, the Cost function is high when an error function, such as the difference between the coded speech and the real speech being coded, is small.

In the codebook search, the Cost function is maximized so that the error function is minimized. For example, suppose first and second tracks (lists of pulse positions in a codebook) contribute respective amounts X and Y to the Cost function and provide a combined contribution to the Cost function. Further suppose X exceeds or is greater than Y, (X>Y). Hence the second track contributes less to the Cost function, the second track is probably underperforming and hence it is to be refined. The process refines the underperforming tracks because that is where refinement can contribute the greatest improvement or increase to the Cost function. Note that the term "track" is sometimes used herein slightly differently than may be the case in the SMV spec. Herein, "track" can refer to the list or set of pulse positions available to a respective pulse, even when another pulse may have an identical list or set of pulse positions available to it. In case a choice needs to be made about refinement as between pulses having an identical list, the pulse having a pulse position in a previous search that contributed less to the Cost function ranks higher or more in need of refinement than a second pulse having the identical list of pulse positions available to it.

In the voiced-stationary case (Type 1), a single codebook of eight (8) pulses is used. In the case of eight tracks, after the refinement is over, the result is that the target $T_g$ is now approximated by all eight (8) pulse positions in eight tracks, namely the two (2) highest-contributing tracks plus six (6) underperforming tracks that got refined and put through filter H. The two highest tracks are included because they were the original best two performers out of the eight. Usually, not all the track candidates are underperformers. In this example, six (6) underperforming tracks are chosen as a trade-off between computational complexity versus best possible track choice pulse position quality. Embodiments suitably vary for different applications, and different implementations of the same application, in the numbers of tracks that are selected for refinement.

In the voiced-non-stationary case (Type 0), any one of three codebooks are used, and this choice is based on secondary excitation characteristics maximizing the Cost function.

Figure 3:
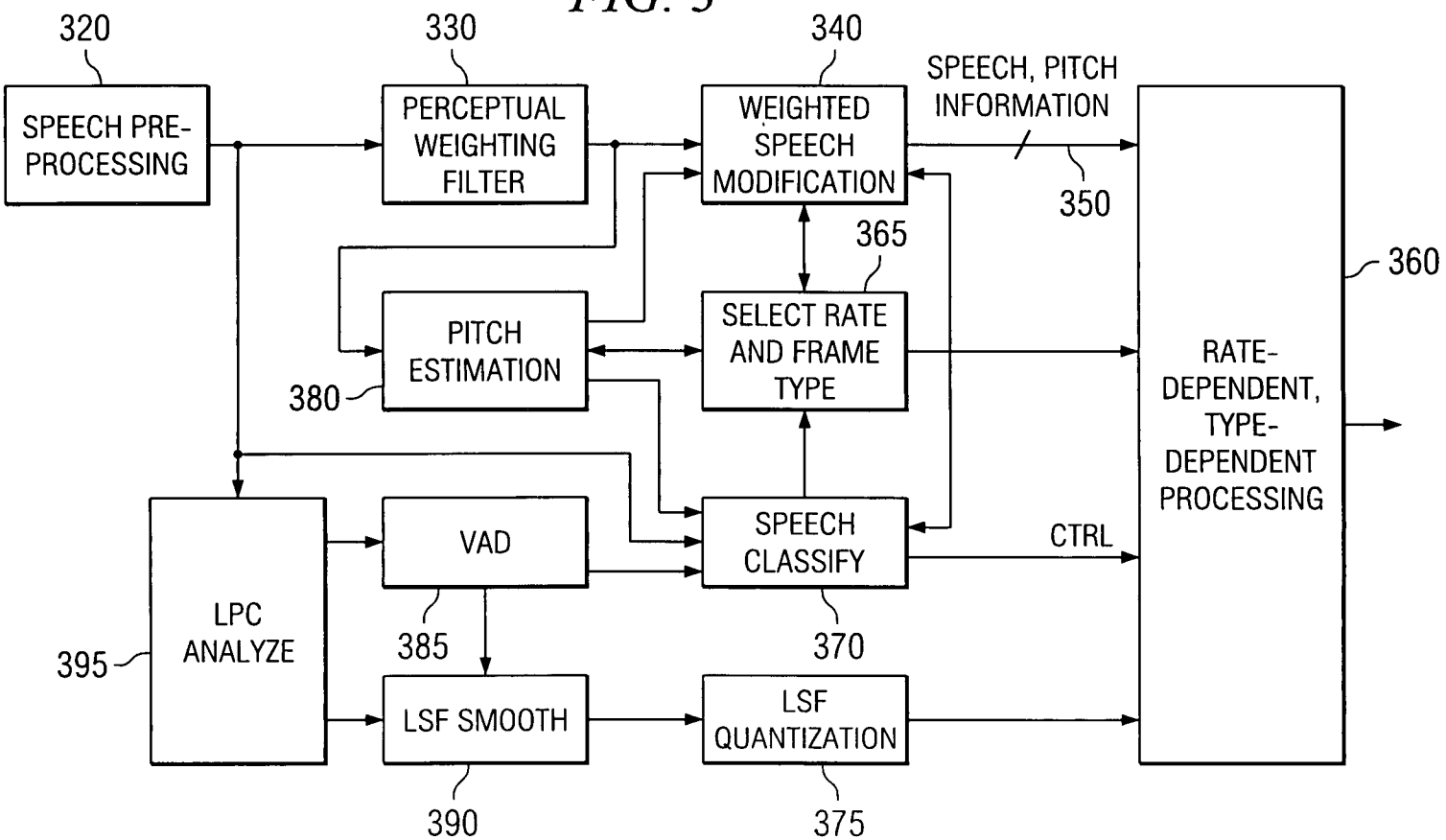
FIG. 3 is a process block diagram of SMV (Selectable Mode Vocoder) as example platform for inventive improvements to blocks as taught herein resulting in an inventive vocoder for the systems and devices of FIGS. 1 and 2.

FIG. 3 shows a method 310 for frame processing which provides the context for improvements over Selectable Mode Vocoder (SMV). Reference is made to "Selectable Mode Vocoder Service Option for Wideband Spread Spectrum Communication Systems," 3GPP2 C.S0030-0, Version 2.0, December, 2001 for background, which is hereby incorporated herein by reference.

A Speech Pre-processor 320 provides pre-processed speech as input to a Perceptual Weighting Filter 330 that produces weighted speech as input to Signal Modification block 340. Block 340 in turn supplies modified weighted speech to a line 350 to Rate and Type Dependent Processing 360. Further blocks 365, 370, 375 supply inputs to Rate and Type Dependent Processing 360. Block 365 provides Rate and Frame Type Selection. Also, blocks 365 and 370 each interact bi-directionally with Weighted Speech Modification block 340. Block 370 provides controls CTRL pertaining to speech classification. Block 375 supplies LSF (Line Spectral Frequency) Quantization information. Line Spectral Frequencies (LSFs) represent the digital filter coefficients in a pseudo-frequency domain for application in the Synthesis Filter 440.

A Pitch Estimation block 380 is fed by Perceptual Weighting Filter 330, and in turn supplies pitch estimation information to Weighted Speech Modification 340, to Select Rate and Frame Type block 365 and to Speech Classify block 370. Speech Classify block 370 is fed with pre-processed speech from Speech Pre-processing block 320, and with controls from a Voice Activity Detection (VAD) block 385. VAD 385 also feeds an output to an LSF Smoothing block 390. LSF Smoothing block 390 in turn is coupled to an input of LSF Quantization block 375. An LPC (Linear Predictive Coding) Analyze block 395 is responsive to Speech Pre-processing 320 to supply LPC analysis information to VAD 385 and to LSF Smoothing 390.

Figure 4:
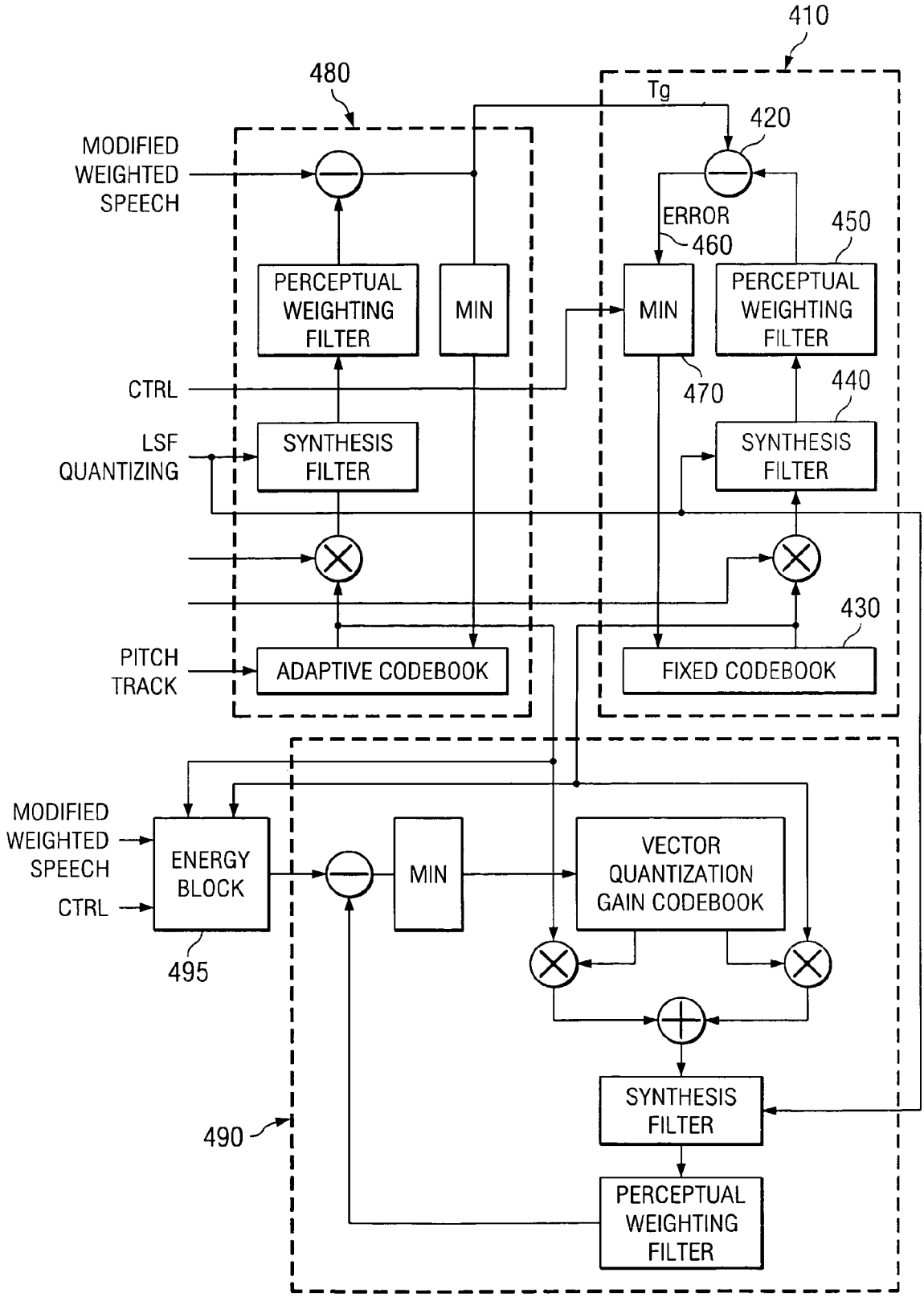
FIG. 4 is a more detailed process block diagram of a Rate and Type Dependent Processing block in FIG. 3, and having codebooks searched according to inventive improvements herein for exciting filter operation to approximate a target signal $T_g$.

FIG. 4 shows greater detail of Rate and Type Dependent Processing 360 of FIG. 3. FIG. 4, among other things, illustrates a method for excitation coding for Rate 1 (full-rate) and Rate ½ (Half Rate). Note in particular a Fixed-Codebook-based analysis-by-synthesis feedback circuit 410. This circuit 410 is related to the subject of the improvements discussed herein. Circuit 410 receives a "target signal" $T_g$ at a subtractor 420. Target signal $T_g$ represents the speech (remaining after adaptive codebook operations in a block 480 near block 410) to be optimally coded by block 410. The fixed codebook block 410 includes a Fixed Codebook operations block 430 followed by a synthesis filter 440. A perceptual weighting filter 450 couples synthesis filter 440 to subtractor 420. An error signal line 460 and Minimization block 470 couple subtractor 420 to fixed codebook block 430 to complete a feedback loop. Minimization block 470 is fed with control CTRL from Speech Classify block 370 of FIG. 3. Synthesis Filter 440 is fed with LSF Quantization information from block 375. Fixed Codebook 430 has an output that is multiplied by optimal fixed codebook gain.

In FIG. 4, an Adaptive Codebook filter block 480 is organized similarly to Fixed Codebook filter block 410 and has a similar loop of Adaptive Codebook, multiplier, Synthesis Filter, Perceptual Weighting Filter, subtractor, and minimization looping back to Adaptive Codebook. Block 480 has a subtractor input for Modified Weighted Speech from block 340. Block 480 has a multiplier input for pitch gain multiplication of Adaptive Codebook output. LSF Quantization from block 375 is provided to the Synthesis Filter in block 480. Completion of the block 480 loop with a minimization block applies to voiced non-stationary (Type 0) frames. Minimization is omitted from the block 480 loop for processing voiced stationary (Type 1) frames.

Further in FIG. 4, an Energy block 495 is fed with Modified Weighted Speech from block 340 of FIG. 3, and with respective outputs from Adaptive Codebook ACB and Fixed Codebook FCB of FIG. 4.

A Vector Quantization Gain Codebook filter block 490 is organized somewhat similarly to Fixed Codebook filter block 410 and has a similar loop, except the Vector Quantization Gain Codebook feeds multipliers respectively fed by Adaptive Codebook and Fixed Codebook 430. In block 490 a Synthesis Filter receives a sum of the multiplier outputs, responds to LSF Quantization input, and is followed by Perceptual Weighting Filter, subtractor, and minimization looping back to Vector Quantization Gain Codebook. Block 490 has a subtractor input fed by the Energy block 495.

FIG. 5 summarizes an aspect of the process of finding the right pulses to excite a filter to approximate the target signal $T_g$. Pre-processed speech from block 320 is weighted by block 330 and is modified by block 340 and sent to codebook processing 550. A fixed codebook has predetermined information that designates time positions for each of a predetermined number of pulses that are allowed to excite the filter(s) for a given type of voice frame. Rate and Type decision signals from block 520 are coupled to the Codebook Processing block 550 in response to processed speech frames originated at block 320. Codebook Processing block 550 has adaptive codebook ACB and fixed codebook FCB. For instance, for analyzing Rate 1 frames, a fixed codebook is provided for analyzing Type 1 frames. Multiple sub-codebooks FCB1, FCB2, FCB3 are provided for analyzing Type 0 frames.

Each of multiple excitation pulses for use in speech excitation approximation is allocated a "track" in the codebook (or sub-codebook). The track for a respective pulse has a list of numbers that designates the set of alternative time positions, i.e., pulse positions that the codebook allows that pulse to occupy. "Codebook searching" involves finding the best number in a given track, and the best combination of pulses with which to define the set or subset of pulses which are identified and selected to excite the filter(s) of the analysis-by-synthesis feedback circuit 410. In this way, the process homes in on the approximation to a target signal $T_g$, for instance.

Various embodiments herein pertain to and improve fixed codebook search in full-rate SMV and other codebook searching applications in voice codecs and otherwise. The existing and inventive methodologies are described below.

"Refinement" means search each of the pairs with joint search (except where the context specifically refers to single-pulse search) and, in the search process, pick the pulses which maximize the Cost function. "Search," "refine" and "refinement" are often used synonymously herein. Searching includes accessing codebook tracks and picking the pulses which maximize the Cost function, which thereby improves the approximation that is the goal of the procedure.

Rate 1 Voiced-Stationary (Type 1):

Standard SMV Methodology: The FCB consists of a combination of eight (8) pulses. The FCB search procedure consists of a sequence of repeated refinements referred to as "turns". Each turn consists of several iterations. In each iteration for a given "turn," the process searches for a best pulse position of each pulse or a pair of pulses, while keeping all the other pulses at their previously determined positions. The eight (8) pulse codebook is searched in two (2) turns using a standard "sequential joint search" procedure. A sequential joint search finds out best two (2) pulses position from the given set of candidate pulse positions specified by two adjacent "tracks" in the FCB. Here each track consists of candidate pulse positions. This is followed by two (2) turns of iterative single pulse search. This described search procedure is computationally very demanding. An efficient alternative to this search procedure is described below.

Method Embodiment: In an embodiment, single pulse search is done in the first turn unlike the two (2) turns of sequential joint search in the standard SMV methodology. This gives the initial estimation of the pulse positions. This is followed by a special process herein called Selective Joint Search unlike the two (2) turns of iterative single pulse search in the standard methodology. In the Selective Joint Search procedure the search is restricted to six tracks in the codebook. These six tracks correspond to the pulses that contribute least to a Cost function that is maximized when the error function is minimized. The error function is based on a mean squared error criterion.

Using this search method embodiment reduces the computational complexity of the fixed codebook search by around 50% without affecting the perceptual quality with respect to standard SMV decoded speech.

Rate 1 Voiced-Non-Stationary (Type 0):

Standard SMV Methodology: SMV uses three (3) sub-codebooks in this case. One of the three sub-codebooks that best models the present secondary excitation is chosen. "Secondary excitation" herein refers to excitation pulses which would be a best selection to drive the filter in block 410 to approximate the target signal $T_g$. "Secondary" refers to block 410 being coupled second electronically after block 480 in FIG. 4. In order to determine the best sub-codebook, a single pulse search procedure is adopted for all the three sub-codebooks.

The sub-codebook that minimizes the error criterion (maximizes the Cost function) is selected. The chosen sub-codebook is refined further using three turns of sequential joint search procedure.

Method Embodiment: In a further embodiment, one of the three sub-codebooks is chosen using a single pulse search. Further refinement of the selected best sub-codebook is done using Selective Joint Search instead of sequential joint search procedure. The same Selective Joint Search procedure as described in Voiced-Stationary (Type 1) case is used for selecting the tracks for further refinement. In the Selective Joint Search procedure the search is restricted to six tracks in the codebook. These six tracks correspond to the pulses that contribute least to a Cost function that is maximized when the error function is minimized. The error function is based on a mean squared error criterion.

Second Method Embodiment: Fast-select one sub-codebook, single-pulse search it, then Selective Joint Search is used to search that sub-codebook. The procedure of selecting one among three sub-codebooks is eliminated. This eliminates the complexity of searching additional two more sub-codebooks. The sub-codebook chosen is a priori decided, or dynamically predetermined prior to the single-pulse search, based on input parameters to the sub-codebook search.

The just-described Method Embodiments reduce the computational complexity of the fixed codebook search by 66% without affecting the perceptual quality with respect to standard SMV decoded speech.

Selective Joint Search is used to improve the voice coding by restricting the search procedure to a reduced number of tracks in the codebook. The tracks associated with the pulses that contribute least to a Cost function criterion are selected as they are more likely to be modified in further refinements.

Among other advantages, the a method embodiment is computationally more efficient as it reduces the computational complexity up to 66% with respect to the standard fixed codebook search in SMV without affecting the perceptual quality of speech. The speech quality for the described method embodiment is perceptually the same with respect to standard SMV. Hence, this procedure can make the implementation of SMV computationally more efficient than the standard SMV.

A high density code upgrade embodiment reduces the computational complexity substantially. Greater channel density in channels per DSP core (9 vs. 7 for SMV) is provided by the embodiment at the same speech quality as SMV. Moreover, the embodiment provides higher speech quality at the same channel density as EVRC.

Reduced complexity fixed codebook search is based on Selective Joint Search as taught herein, compared to the higher complexity of fixed codebook search in SMV. In the SMV standard approach, high-complexity searches for best sub-codebook and best pulse positions are used. In an embodiment, a low complexity intelligent search best-guesses the pulse tracks for refinement. Also, the remarkable Selective Joint Search provides a simpler procedure to find the best pulse position.

FIG. 6 shows an error function epsilon as a composite data structure or function of target signal $T_g$, gain g, filter matrix H, and excitation vector c. The error function is the mean square of the difference signal 460 (recall subtractor 420 of FIG. 4) produced as the subtraction difference between the target signal $T_g$ and the approximation of the codebook pulses-excited filter(s). (The error function somewhat resembles error variance, also known as mean square of residuals, as used in the terminology of regression analysis in statistics, but here a very rapidly occurring time series of data comprised in the frame is involved.) That approximation is represented by matrix multiplication product "g H c" in FIG. 6, where c is the excitation vector of the pulses, H is an impulse response matrix representing the filter(s), and g is a gain or multiplier.

For purposes of FIG. 6, codebook search involves proper selection of the pulses in the column vector c. (This impulse response matrix is lower-triangular when backward pitch enhancements are folded into the code-vector. The impulse response matrix is not necessarily lower-triangular when backward pitch enhancements are folded into the impulse response matrix.) Here the approach is to break up vector c into a single pulse $p_i$ (lower right one "1" in column of zeroes) added to a vector of everything else ("c-") that may have so far resulted from codebook search to determine vector c. The "c-" vector correspondingly has a zero in the row entry where single pulse $p_i$ has a one (1). The rows of vector c correspond to pulse positions.

Much of this discussion is devoted to improving the process of searching to find how many "ones" (or pulses) should be entered into which rows (estimated pulse positions) of vector c.

To reduce the computational complexity, some embodiments perform the search using the Cost function epsilon tilde as a goodness of fit metric. Instead, of squaring many differences, the processor is operated to generate a bit-representation of a number and then square it to obtain a numerator, and then computes a bit-representation of a denominator number and then performs a division of the numerator by the denominator.

A goal in Fixed Codebook search is to minimize the epsilon (error function) in the equation (1)

$$\epsilon=\|T_g-gHc\|^2 \tag{1}$$

Alternatively this is equivalent to maximizing epsilon tilde as follows. Epsilon tilde is an example of what is called a "Cost function" herein.

$$\tilde{\varepsilon}=\frac{((T_g)^T Hc)^2}{\|Hc\|^2}=\frac{\left((H^T T_g)^T c\right)^2}{c^T H^T Hc}=\frac{((Tg^T H)c)^2}{(Hc)^T Hc} \tag{2}$$

Substituting symbols $b_{Tg}=(H^T T_g)^T$ and y=Hc, also yields the form:

$$\tilde{\varepsilon}=\frac{(b_{Tg}c)^2}{y^T y} \tag{3}$$

In some of the fixed codebook search embodiments herein, the Cost function epsilon tilde $\tilde{\epsilon}$ is maximized. Maximizing that Cost function is computationally simpler than and equivalent to minimizing the error function $\epsilon$ itself.

In fixed codebook FCB search, finding the best combination of pulse positions in tracks which maximize the Cost function $\tilde{\epsilon}$ is more important than finding the combination of individual best pulses from each track T. In the Selective Joint Search approach herein, the contribution C(Tx) from a particular track Tx is defined, for one example and one type of method embodiment, as the difference in Cost function $\tilde{\epsilon}$ after eliminating the candidate pulse position from the initial state before Selective Joint Search. For example, let x,y,z,w be candidate pulse positions from different tracks Tx, Ty, Tz, Tw before the start of selective joint search. The overall Cost function is $\tilde{\epsilon}$ (x,y,z,w). The contribution C of position x to the Cost function is defined as $$Cx=\tilde{\epsilon}(x,y,z,w)-\tilde{\epsilon}(y,z,w). \tag{4X}$$

Similarly, $$Cy=\tilde{\epsilon}(x,y,z,w)-\tilde{\epsilon}(x,z,w), \tag{4Y}$$

$$Cz=\tilde{\epsilon}(x,y,z,w)-\tilde{\epsilon}(x,y,w) \text{ and} \tag{4Z}$$

$$Cw=\tilde{\epsilon}(x,y,z,w)-\tilde{\epsilon}(x,y,z). \tag{4W}$$

Now if Cx is highest among Cx, Cy, Cz, Cw, then eliminating candidate pulse position x will result in high error. In other words, the candidate pulse position x is already well fitted with other selected pulse positions to minimize the error, that is, deliver a highest possible value of the Cost function $\tilde{\epsilon}$. Hence, this track Tx containing candidate pulse position x need not be refined. If, for another instance, contribution Cz is least, then refining the track Tz containing pulse position z is expected to improve the Cost function $\tilde{\epsilon}$ in a manner which best combines or gels with other candidate pulse positions to give high Cost function measure $\tilde{\epsilon}$(x,y,z',w) where z' is candidate pulse position refined from the track same as z. (Symbol prime (') on a pulse letter here represents refinement.)

Note that any selecting the "least contribution" can be accomplished using any data structure or function that either increases as the differences of Equations (4) increase or, alternatively, decreases as the differences of Equations (4) increase. For instance, the formula of Equation (4X) could be replaced with a division formula $$Cx=\tilde{\epsilon}(x,y,z,w)/\tilde{\epsilon}(y,z,w). \tag{4X2}$$

Similarly, if the formulas of Equations (4) are reversed in sign, then the "least contribution" is the contribution that still has the least magnitude but now the highest difference value (as thus sign-reversed) since the contribution values are arranged reversely along the number line by the simple reversal in sign.

Still another example recognizes that the Cost function value $\tilde{\epsilon}$(x,y,z,w) is the same in all the difference Equations(4). Accordingly, in this example, operations in the processor suitably select first for refinement the track T (or track pair as the case may be) that corresponds to the highest value of Cost function value in a set of Cost function values {$\tilde{\epsilon}$(x,y,z), $\tilde{\epsilon}$(w,y,z), $\tilde{\epsilon}$(w,x,z), $\tilde{\epsilon}$(w,x,y)} when the pulse having the pulse position from that track is omitted.

$$\text{Track Selection } Ts=\text{track with Max}(\{\tilde{\epsilon}(x,y,z),\tilde{\epsilon}(w,y,z),\tilde{\epsilon}(w,x,z),\tilde{\epsilon}(\text{w,x,y})\} \tag{5}$$

The selection of Equation (5) is made because the track Ts, when omitted, is revealed to have been making the least contribution because the Cost function value with that track Ts omitted is the highest of any of the Cost function values even though that track Ts is omitted. Also, in some embodiments the refinement of tracks occurs in rigorous order of least contribution, and in other embodiments as simulation tests may suggest, another approximately-related order based on some selection of lower-contribution track(s) suitably guides the processor operations.

Accordingly, applying the important selection method of "least contribution" as taught herein comprehends a variety of alternative embodiments of operational methods which may involve selecting a highest or lowest value of a function with track omitted, or a highest or lowest value of a difference-related function between values with none, fewer and more subset(s) of track(s) omitted.

Figure 7:
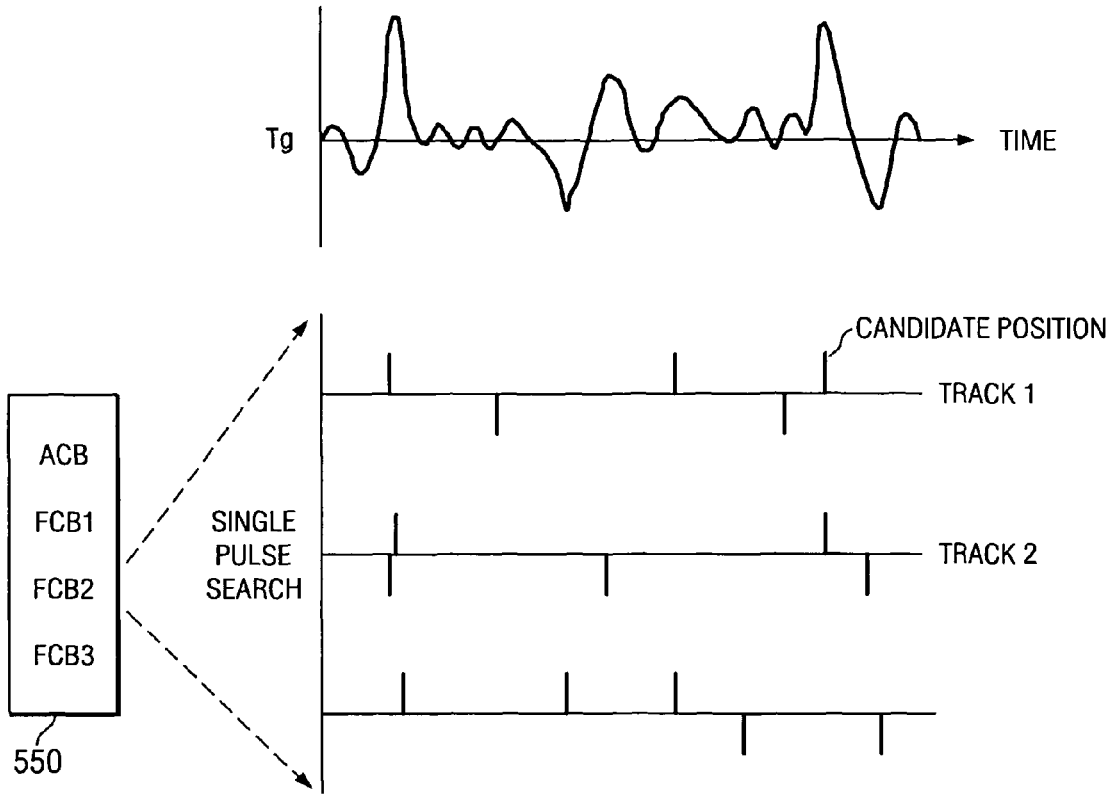
FIG. 7 is a composite illustration of a codebook block of FIG. 5 next to pulse tracks in a pulse search to find excitation pulses used with the filter of FIGS. 4 and 6 to approximate a target signal $T_g$.

FIG. 7 pictorially shows the target to be matched, namely target signal $T_g$ as a wavy electrical signal which is converted to digital form for digital processing according to an improved method that is suitably programmed in software. In a "single pulse search," a first single pulse is varied among the codebook first-track-specified row positions in the vector representing single pulse $p_i$ to find a "best" row position where the error function of FIG. 6 is minimized. Then keeping that first one pulse in its "best" row position, a second single pulse is introduced and varied among the codebook second-track-specified row positions in the vector representing single pulse $p_i$ to find a "best" row position for the second single pulse where the error function of FIG. 6 is minimized. Then keeping the first and second single pulses in their "best" position, additional single pulses are introduced up to the number of tracks in the codebook, if any more tracks exist in the codebook.

Figure 8:
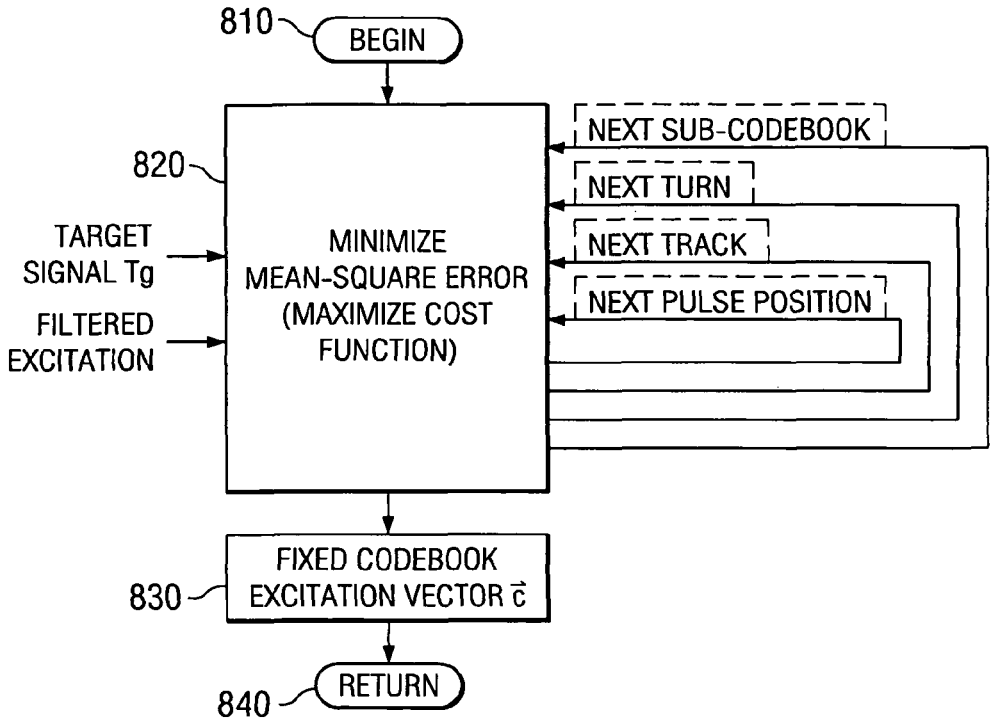
FIG. 8 is a process flow diagram of a single-pulse search procedure for finding excitation pulses in FIGS. 3-7.

FIG. 8 shows a flow diagram of the single pulse search. Operations commence at BEGIN 810 and proceed in a step 820 to minimize the mean-square error of FIG. 6. Operations in step 820 follow nested loops of processor operation. An inner loop moves the pulse, i.e. changes the pulse vector to new values on a given track in the codebook. A next outer loop goes to the next track and introduces an additional single pulse as discussed in the paragraph above. (In the SMV code, searching the codebooks does not explicitly involve software loops, but the process is suitably viewed as a loop for searching multiple codebooks.) A next outer loop goes to the next "Turn" meaning an additional search that starts with the pulse positions estimated in a previous codebook search, such as by the inner loops of FIG. 8. An outermost loop searches additional sub-codebooks. The result supplied in step 830 from step 820 is a fixed codebook excitation vector c which represents the estimated pulse positions of the respective pulses corresponding to the codebook tracks, whereupon RETURN 840 is reached.

Figure 9:
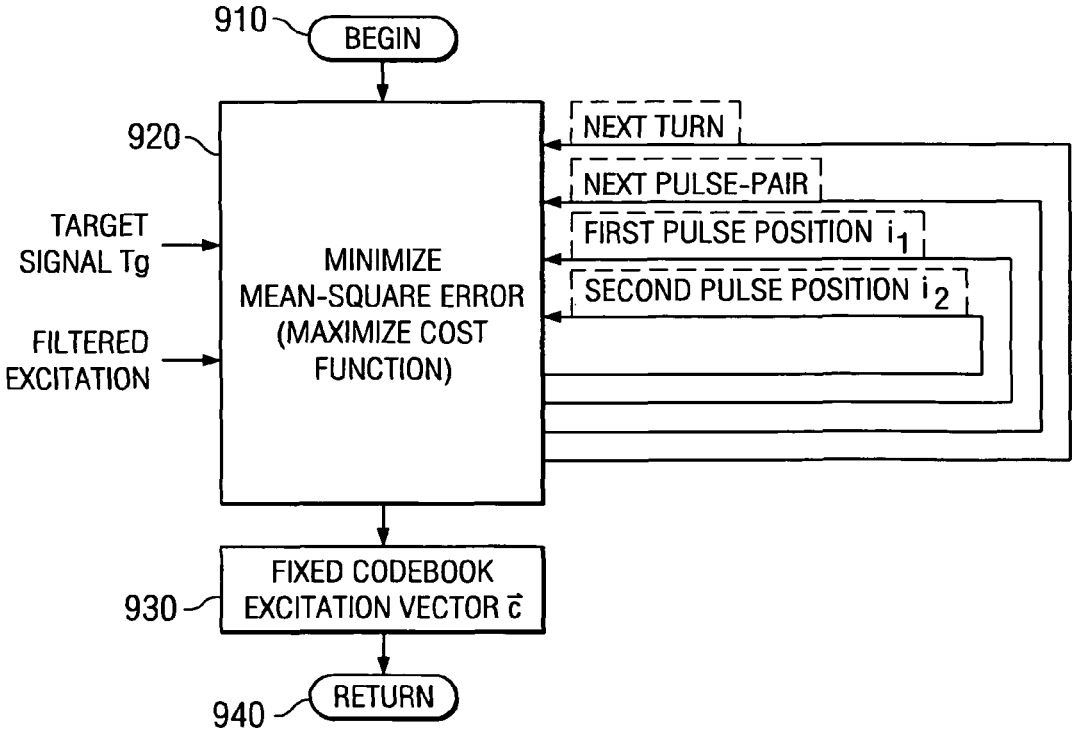
FIG. 9 is a process flow diagram of a 2-pulse sequential joint position search procedure for finding excitation pulses in FIGS. 3-7.

FIG. 9 shows a flow diagram of a different kind of pulse search, called 2-pulse sequential joint position search, or just sequential joint search. Operations commence at BEGIN 910 and proceed in a step 920 to minimize the mean-square error of FIG. 6. Operations in step 920 follow different nested loops of processor operation. For a pair of pulses corresponding to two selected tracks of the codebook, an inner loop moves a pulse i2 among the pulse positions in the track having the greater number of pulse position entries compared to the other track in the two selected tracks. A next inner loop moves a pulse i1 among the pulse positions in that other track of the two selected tracks. A next outer loop goes to a next pair of tracks and moves a pair of pulses by executing the inner loops. The outermost loop goes to a next "Turn" meaning an additional search that starts with the pulse positions estimated in a previous codebook search, such as by the inner loops of FIG. 9. The result supplied in step 930 from step 920 is a fixed codebook excitation vector c resulting from sequential joint search. The excitation vector c represents estimated pulse positions of the respective pulses corresponding to the pairs of codebook tracks, whereupon RETURN 940 is reached.

FIG. 10 illustrates a method called sequential joint search to match wavy electrical target signal $T_g$ of FIG. 7 with a digital form for digital processing according to an improved method herein suitably programmed in software. In a "sequential joint search," pulses in a pair of tracks are varied among the codebook track-specified row positions in vectors representing pulses $p_i$ to find a "best" pair of row positions where the error function of FIG. 6 is minimized. Then keeping those first two pulses in their "best" row positions, a second pair of pulses is introduced and varied among the codebook second track-pair-specified row positions in vectors representing pulses $p_i$ to find a "best" pair of row position where the error function of FIG. 6 is minimized. The process is repeated until all pairs of the tracks are used up from the codebook.

FIG. 10 further goes on to illustrate Selective Joint Search, which is a key conception herein for improving codebook searching. Selective Joint Search is an improved method for searching for best positions for pulses in pairs where the search is restricted to fewer than all the tracks in the codebook being searched. One embodiment restricts joint position search to 6 tracks out of an 8 track codebook. These 6 tracks correspond to the 6 pulses that contribute least to the Cost function, which is inversely related to the mean squared error criterion. Selective Joint Search is not found in SMV.

In FIG. 11, a comparison of flows for SMV on left with improved method herein on right is directed to Type 1 frames such as for Rate 1.

Type 1: For voiced stationary frames (Type 1), an example of the improved method 1150 at right in FIG. 11B has a BEGIN 1155 and then a step 1160 searches the one 8-track codebook, using a single pulse search in the first turn. Then a step 1170 finds the tracks for pulse positions contributing least to the Cost function of Equation (2). Next, a step 1180 of the method employs the special Selective Joint Search on the six tracks corresponding to the best six pulses out of eight, whence RETURN 1195 is reached.

Thus, for voiced stationary frames (Type 1) the improved method provides one (1) turn of Single pulse search followed immediately thereafter by Selective Joint Search. The concept of turn as defined by the SMV Standard is no longer meaningful for purposes of some of the embodiments. For Type 1 frames the improvement replaces four (4) turns of SMV prior execution with an improved method that requires only about half (about 50%) the computations.

Now look at the SMV flow at left in an unimproved method of FIG. 11A. In the standard SMV method of Joint Search For Turn 1 of Type 1 voiced stationary frames using the 8-track codebook: a START 1105 is followed by a step 1110 wherein Tracks (0,1), (2,3), (4,5), (6,7) are 2-pulse jointly searched in sequential fashion. A decision step 1115 determines that a second turn remains to be executed, and operations loop back to step 1110. In step 1110 for Turn 2: Tracks (1,2), (3,4), (5,6) are jointly searched in sequential fashion. See also FIG. 14 upper left sequential joint search, turns 1 and 2. Then a step 1120 refines the candidate pulse positions using single pulse search, followed by decision step 1125 which loops back to step 1120 for a second turn, whence operation reach END 1130.

Figure 14:
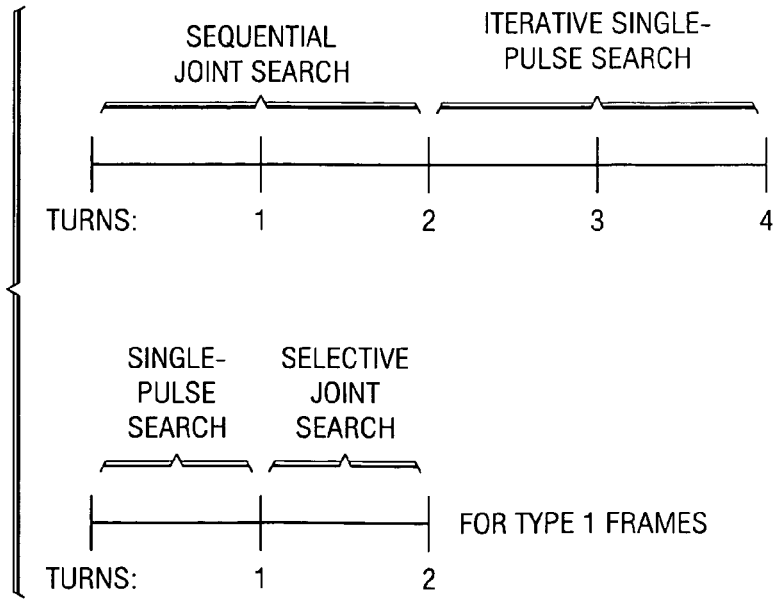
FIG. 14 is a timing diagram of an inventive method of finding or determining excitation pulses in FIGS. 3-7 for voiced stationary (Type 1) frames.

But in the Selective Joint Search approach used just after Turn 1 in the improved search shown as the lower portion of FIG. 14 and in FIG. 11B, the tracks selected on refinement are based on the Cost function criteria. For example, suppose that the six lowest contributions to the Cost function, ordered from least to most were from tracks 2, 5, 7, 8, 1, and 6. Then the Selective Joint Search approach searches track pairs (2,5) (7,8) (1,6) in that order, from least to most contribution to the Cost function.

Selective Joint Search thus picks or selects the possible candidates for the joint search to be conducted. Selective Joint Search specifically predicts or establishes which of the pulse tracks should be searched among the whole set.

An even further improved Selective Joint Search embodiment comprehended in the flow on right in FIG. 11B limits the number of pairs of tracks to two (2) instead of three (3) for purposes of Selective Joint Search. Also additional rules are imposed on the pair of tracks that are jointly refined.

Figure 12A:
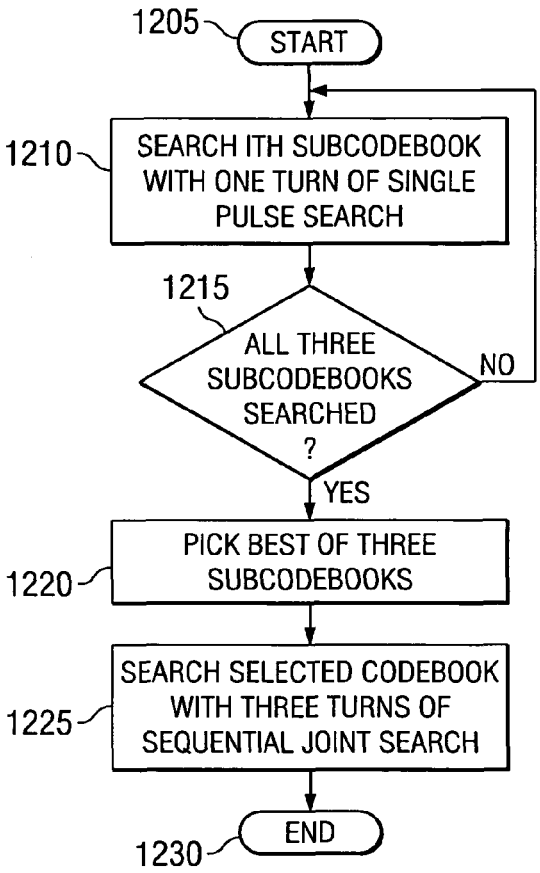
FIG. 12A is a flow diagram of a standard SMV method of searching for pulses for Rate 1, voiced non-stationary (Type 0) frames.
Figure 12B:
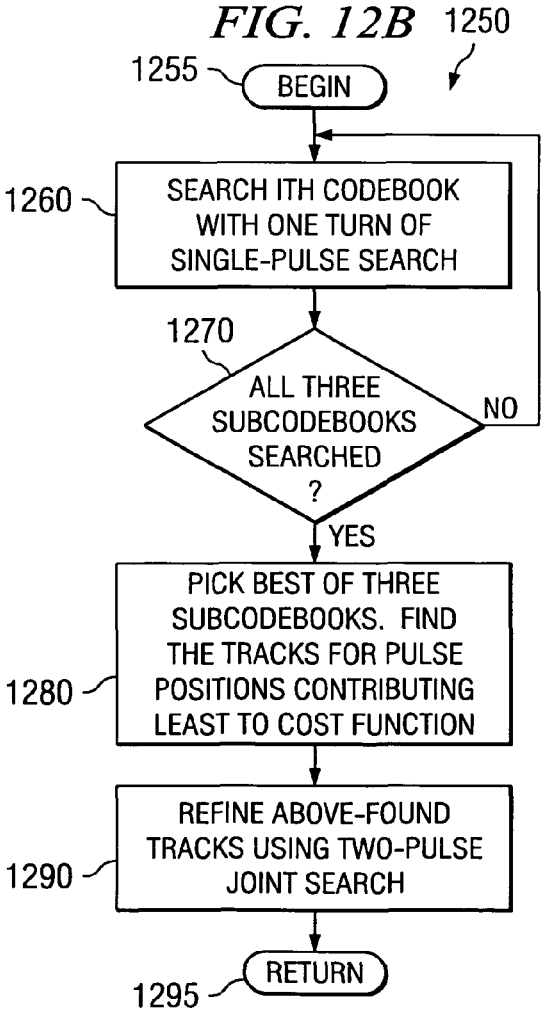
FIG. 12B is a flow diagram of an inventive method of finding or determining excitation pulses in FIGS. 3-7 for Rate 1, voiced non-stationary (Type 0) frames.

A comparison of flows for SMV in FIG. 12A on left with improved method in FIG. 12B on right is directed to voiced non-stationary (Type 0) frames such as for Rate 1.

Type 0: For all other frames (Type 0), an unimproved method of FIG. 12A (and top line of FIG. 15) commences with a BEGIN 1205 and proceeds to step 1210 and decision step 1215 to single-pulse search the three 5-track sub-codebooks (each with a single turn for total of 3 turns). Then the method of FIG. 12A picks the best of the three sub-codebooks in a step 1220. Then that unimproved method searches the selected sub-codebook in a step 1225 with three time-consuming turns of sequential joint search, whence an END 1230 is reached.

Type 0: For all other frames (Type 0), an improved method uses Selective Joint Search as shown on right in FIG. 12B. The FIG. 12B improved method 1250 commences with BEGIN 1255 and proceeds to step 1260 and decision step 1270 to single-pulse search the three 5-track sub-codebooks (each with a single turn for total of 3 turns) as in FIG. 8. Then the method of FIG. 12B advantageously follows up in step 1280 not only with picking the best of the three sub-codebooks but also using the special Selective Joint Search procedure of identifying two pairs of tracks for the pulse positions contributing least to the Cost function and thus most in need of refinement. Then in a step 1290, Selective Joint Search advantageously refines those two pairs of tracks as in FIG. 9 with sequential joint search utilized so much less that only one-third the complexity is incurred.

For Type 0, the improved method on right in FIG. 12B thus replaces SMV's three turns of sequential joint search shown on left in FIG. 12A with one execution of the new Selective Joint Search for a savings of about two-thirds or 66% (not counting the previous sub-codebook searching turns).

For Type 0 frames, the Selective Joint Search on right in FIG. 12B instead refines two (2) pairs of tracks rather than six (6) pairs of tracks (6×2=12 tracks) in standard SMV. "Refine" and "refinement" for this purpose means searching each of the pairs with joint search and picking the pulses which maximize the Cost function. Six (6) pairs of tracks is equivalent to three (3) turns of Sequential Joint Search in Full Rate Type 0 frames. In standard SMV on left in FIG. 12A for Full Rate Type 0 frames, sequential joint search is done in 3 turns. In the first turn of standard SMV sequential joint search, Tracks (0,1) & (2,3) are refined. In the second turn of standard SMV sequential joint search, Tracks (1,2) & (3,4) are refined. In the third turn of standard SMV sequential joint search, Tracks (0,1) & (2,3) are refined. i.e. 6 pairs of tracks or 12 tracks are refined.

As noted in the previous paragraph, for Type 0 frames, the Selective Joint Search of the improved method on right in FIG. 12B instead refines two (2) pairs of tracks rather than six (6) pairs of tracks (6×2=12 tracks) in Standard SMV. In other words the Selective Joint Search improvement uses only four (4) tracks for Type 0 frames.

A turn of single-pulse search is performed on all five tracks in each sub-codebook beforehand. In other words, for each of three (3) sub-codebooks in Type 0 frames, one single turn search for each sub-codebook is performed independently. The sub-codebook that resulted in the highest value of the Cost function is selected as the best sub-codebook for further processing. In the single-pulse searching, the respective contributions to Cost function by each of the tracks in the selected sub-codebook were advantageously recorded and are retained, at least temporarily. These contributions are used to rank the tracks T=0, 1, 2, 3, 4 by contribution T(C0), T(C1), T(C2), T(C3), T(C4) from highest contribution track T(C0) to Cost function to lowest contribution track T(C4). Then the lowest-performing pair of tracks {T(C3), T(C4)} is refined first by joint search, and then the next lowest-performing pair of tracks {T(C2), T(C1)} is refined second by joint search. In this way, the Selective Joint Search improvement advantageously refines only two pairs of tracks (only 4 tracks) for searching Type 0 frames at this point instead of six pairs of tracks (12) tracks as in the Standard SMV. As a further advantage, the two (2) pairs of tracks selected in FIG. 12B for refinement in the remarkable Selective Joint Search are selected dynamically based on the Cost function.

Figure 13:
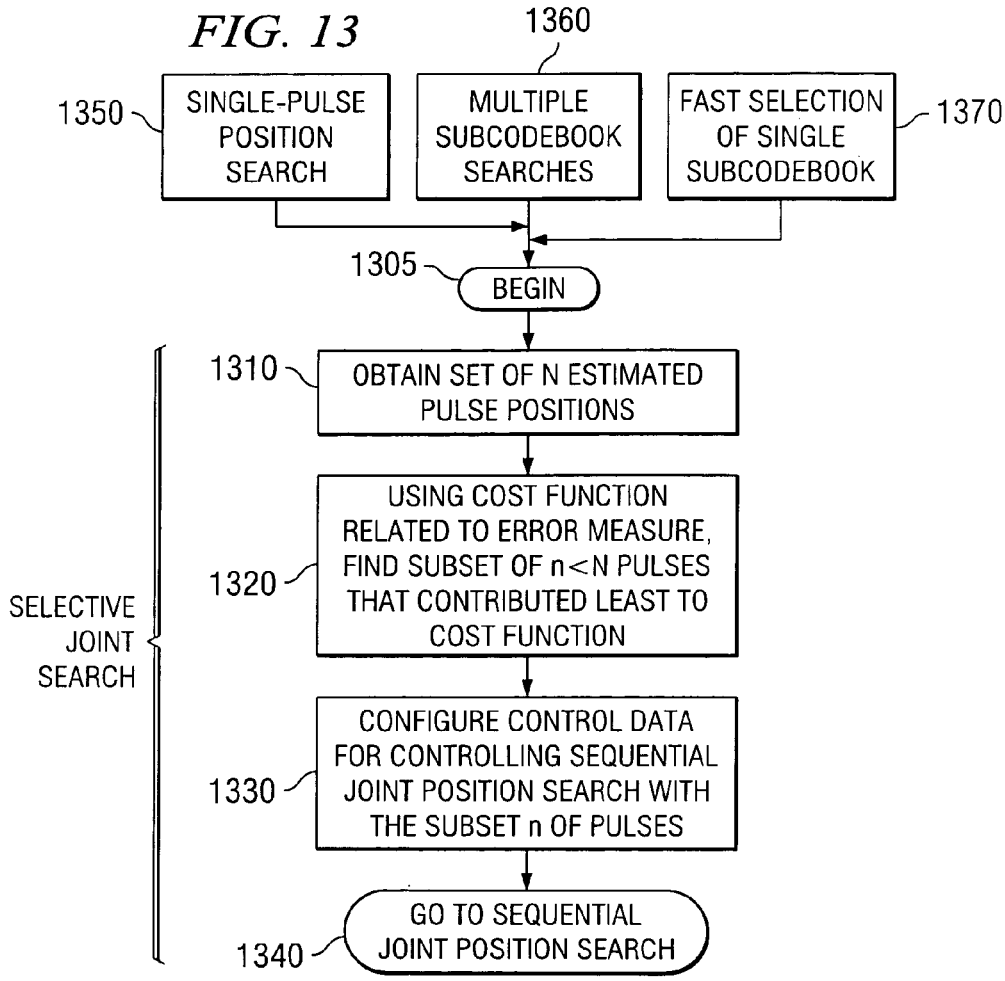
FIG. 13 is a flow diagram of an inventive method of finding or determining excitation pulses in FIGS. 3-7 for voiced frames wherein the flow diagram shows some inventive features common to inventive processes in FIGS. 11B, 12B, 14 and 15.

In FIG. 13, various improved methods of codebook search are summarized.

In FIG. 13, operations commence with BEGIN 1305 of Selective Joint Search. Operations proceed in step 1310 to obtain a set of estimated pulse positions having a first number N of tracks of the estimated pulse positions. Next a step 1320 uses a Cost function measure to find a best subset of a second number n of pulse tracks fewer in number than the first number N wherein the subset of pulse tracks contributed less to the the Cost function measure than any other subset of the pulse tracks equal in number to the second number n of pulse tracks. A succeeding step 1330 configures control data for controlling a subsequent pulse position search beginning in order with the estimated pulse tracks pertaining to the least-contributing subset of pulse tracks. This method embodiment yields refined estimated pulse positions. Then a step 1340 goes to and executes a sequential joint position search of FIG. 9, to do a subsequent pulse position search for refined estimated pulse positions of pulses in at least one pair of pulse tracks thus identified and established by Selective Joint Search.

Further in FIG. 13, the obtaining process includes a single-pulse position search 1350 for estimated pulse positions of pulses prior to BEGIN 1305 so that step 1310 is provided with the estimated pulse positions. Advantageously, only one turn of single-pulse position search is sufficient for Type 1 frames in the improved fast codebook search of FIG. 14 for Type 1 frames.

Figure 15:
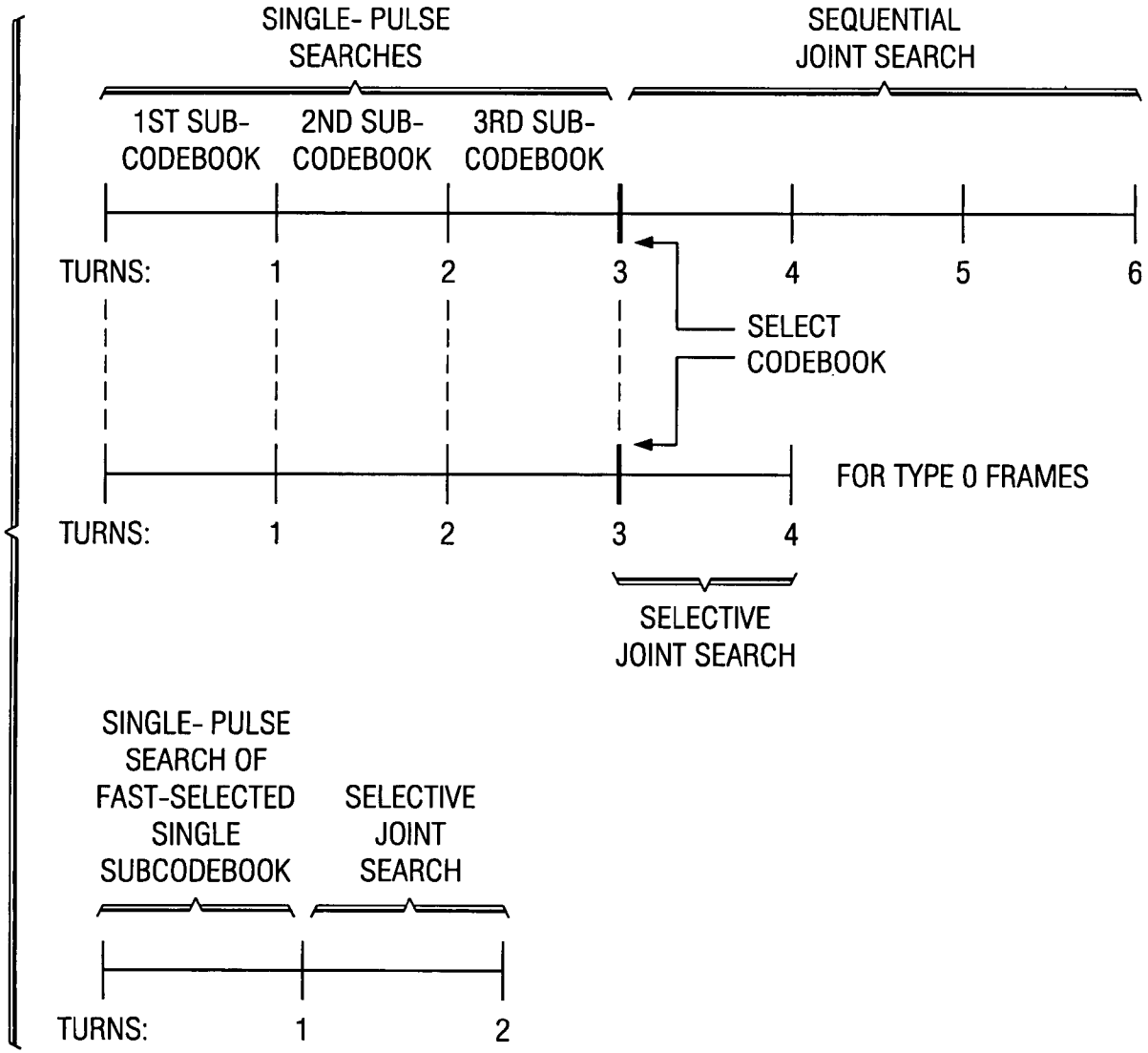
FIG. 15 is a timing diagram of an inventive method of finding or determining excitation pulses in FIGS. 3-7 for voiced non-stationary (Type 0) frames.

In FIG. 15, advantageously, only one turn of a single-pulse search of fast-selected single codebook is sufficient for Type 0 frames in a very fast embodiment of improved codebook search of FIG. 15 (bottom line). In that very fast embodiment for Type 0, the process selects by step 13705 of FIG. 13 a preferred sub-codebook from a number of sub-codebooks, and executes a single-pulse position search of the preferred sub-codebook to obtain the estimated pulse positions.

The sub-codebook chosen is a priori decided, in one embodiment, to be the second 5-Pulse sub-codebook for Rate 1, Type 0 frames of SMV (Table 5.6-3 of SMV Spec). The a priori choice in general selects the sub-codebook offering reduced computational complexity, which is less than for the extensive first SMV 5-Pulse sub-codebook (Table 5.6-2 of SMV Spec) and comparable to third SMV 5-Pulse sub-codebook. Also, the pulse positions structure of the second 5-Pulse sub-codebook is more flexible than 3rd subcodebook (Table 5.6-4 of SMV Spec) because the second 5-Pulse sub-codebook values span a wider range of numerical choices. Accordingly, the second 5-Pulse sub-codebook is a priori chosen and automatically selected at the beginning of the process of FIG. 15, last line, in this very fast embodiment.

In an alternative embodiment, the chosen sub-codebook is dynamically predetermined prior to the single-pulse search, based on input parameters to the sub-codebook search. The predetermination process utilizes information computed during signal modification in block 340 (FIG. 3) of the weighted speech signal. The modification of the weighted voiced speech is conducted on a variable subframe basis. The subframe size is related to pitch lag value and the location of the subframe within a frame. The number of variable subframes is calculated for each frame. Typically for stationary voiced (Type 1) frames the number of variable subframes is limited due to its relation to pitch lag value which is limited to minimum of 17. However for certain non stationary voiced (Type 0) frames, which occur rarely, the number of variable subframes are high. For Type 0 frames the information of number of variable subframes is utilized to conditionally eliminate two of three sub-codebook fixed code book single pulse searches.

The significance is that on a statistical basis and understanding of signal modification properties, it rarely happens that the number of variable subframes exceeds eight (8). Whenever that number exceeds eight (8), the sub-codebook is pre-selected. The complexity of signal modification increases with number of variable subframes. The increase in complexity in signal modification is reduced by pre-selection of the sub-codebook without affecting the quality of the speech.

In another fast embodiment of improved codebook search of FIG. 15 (middle line), the obtaining process in FIG. 13 applies a step 1360 to provide a plurality of single-pulse position searches of respective sub-codebooks prior to BEGIN 1305 and step 1310. Step 1360 identifies which one of the respective sub-codebooks is best in the sense of making the Cost function the highest in value. Then that best sub-codebook is selected. The estimated pulse positions resulting from the single-pulse position search of the sub-codebook thus identified or selected are the estimated pulse positions obtained for step 1310.

In FIG. 13, after the configuring in step 1330, the step 1340 executes sequential joint position search beginning with the estimated pulse positions pertaining to the least-contributing pulse tracks. This yields refined estimated pulse positions of the best subset of pulses. In FIG. 14 (lower line) for Type 1 frames and FIG. 15 (lower two lines) for Type 0 frames, the Selective Joint Search examples use some or all of FIG. 13 steps 1310, 1320, 1330, 1340.

Correspondingly, and looking above and in FIG. 2, an electronic circuit includes a processor circuit and a storage circuit establishing voice coding for execution by the processor. These circuits are suitably practiced in integrated circuit 1100 and/or 1400 by using any one, some or all of audio block 1170, RISC, DSP, RAM and ROM. The voice coding using Selective Joint Search of any of FIG. 13, and/or FIG. 14 (lower line) and/or FIG. 15 (either of the lower two lines) is operable to obtain a set of estimated pulse positions having a first number N of pulse tracks of the estimated pulse positions, use a cost function to find a subset including a second number n of pulse tracks fewer in number than the first number N wherein the subset of pulse tracks contributed least to the cost function relative to any other equally-numerous subset of n pulse tracks, and control a subsequent pulse position search beginning with the estimated pulse positions pertaining to that least-contributing subset of pulse tracks to yield refined estimated pulse positions.

Applications of Improvements in Other Codecs

GSM AMR (Global System for Mobile) (Adaptive Multi-Rate)(ETSI GSM 06.90) is a multi-rate Algebraic CELP (ACELP) voice codec applicable to GSM 2 and higher generations and WCDMA. WB-AMR (Wide Band Adaptive Multi-Rate) is a multi rate ACELP codec operable to higher bit rates for wideband speech. ITU G.722.2 and 3GPP GSM-AMR WB codecs use WB-AMR. WB-AMR is useful for combined wireless/wired solutions. EFR (Enhanced Full Rate) GSM 06.60 is another ACELP codec. All the foregoing codecs can be suitably improved by applying the teachings herein.

In CDMA and other systems, the improvements taught herein are suitably applied to EVRC (Enhanced Variable Rate Codec) (TIA IS-127). EVRC is a Relaxation Code Excited Linear prediction (RCELP) type codec having various rates.

Among other standards initiatives, without limitation, to which the improvements herein are suitably applied are ITU G.723.1 and G.729 and beyond and improvements to MPEG4-CELP (ISO/IEC 14496-3) and beyond.

A few preferred embodiments have been described in detail hereinabove. It is to be understood that the scope of the invention comprehends embodiments different from those described yet within the inventive scope. Microprocessor and microcomputer are synonymous herein. Processing circuitry comprehends digital, analog and mixed signal (digital/analog) integrated circuits, ASIC circuits, PALs, PLAs, decoders, memories, non-software based processors, and other circuitry, and digital computers including microprocessors and microcomputers of any architecture, or combinations thereof. Internal and external couplings and connections can be ohmic, capacitive, direct or indirect via intervening circuits or otherwise as desirable. Implementation is contemplated in discrete components or fully integrated circuits in any materials family and combinations thereof. Various embodiments of the invention employ hardware, software or firmware. Block diagrams of hardware are suitably used to represent processes and process diagrams and vice-versa. Process diagrams herein are representative of flow diagrams for operations of any embodiments whether of hardware, software, or firmware, and processes of manufacture thereof.

While this invention has been described with reference to illustrative embodiments, this description is not to be construed in a limiting sense. Various modifications and combinations of the illustrative embodiments, as well as other embodiments of the invention may be made. The terms "including", "includes", "having", "has", "with", or variants thereof are used in the detailed description and the claims to denote non-exhaustive inclusion in a manner similar to the term "comprising". It is therefore contemplated that the appended claims and their equivalents cover any such embodiments, modifications, and embodiments as fall within the true scope of the invention.

What is claimed is:

1. An electronic circuit comprising:

a processor circuit and a storage circuit establishing a speech coder for execution by said processor circuit, the speech coder for approximating speech by pulses having pulse positions selectable from a codebook, the speech coder operable to obtain from the codebook a set of estimated pulse positions having a first number of pulse tracks of the estimated pulse positions, use a cost function relating to approximation to speech to find a first subset including a second number of one or more pulse tracks fewer in number than the first number wherein the first subset of pulse tracks contributed a lower contribution to the cost function relative to a second subset of pulse tracks, and control a subsequent pulse position search beginning with the lower-contributing subset of pulse tracks to yield second pulse positions to provide a value of the cost function representing a better approximation to speech.

2. The electronic circuit of claim 1 wherein the lower contribution is the least contribution to the cost function relative any other equally-numerous subset of pulse tracks.

3. The electronic circuit of claim 1 wherein the second subset of pulse tracks is equally-numerous to the first subset.

4. The electronic circuit of claim 1 wherein the lower contribution is the least contribution to the cost function relative any other equally-numerous subset of pulse tracks and the second subset of pulse tracks is equally-numerous to the first subset.

5. The electronic circuit of claim 1 wherein the speech coder is operable to control a search of plural subsets of pulse tracks in order of least-contribution to next-higher contribution by the subsets of pulse tracks.

6. The electronic circuit of claim 1 wherein the speech coder is operable to single-pulse position search to obtain the estimated pulse positions.

7. The electronic circuit of claim 1 wherein the speech coder is operable to perform a plurality of single-pulse position searches of respective sub-codebooks to obtain the estimated pulse positions.

8. The electronic circuit of claim 7 wherein the speech coder is operable to identify which one of the respective sub-codebooks contributes most to the cost function to obtain the estimated pulse positions resulting from the single-pulse position search of the sub-codebook thus identified.

9. The electronic circuit of claim 1 wherein the speech coder is operable to select from a number of sub-codebooks a preferred sub-codebook, and to control a pulse position search of pairs of pulse tracks from the preferred sub-codebook in order of least-contribution to next-higher contribution by the pairs of pulse tracks to obtain the estimated pulse positions.

10. The electronic circuit of claim 1 wherein the speech coder has rates including a higher rate and a lower rate, and wherein the electronic circuit performs the control as aforesaid at the higher rate only.

11. The electronic circuit of claim 1 wherein the speech coder has voiced stationary speech frames and voiced non-stationary speech frames and wherein the speech coder is operable to perform the use and control to process both types of speech frames at least one rate.

12. The electronic circuit of claim 1 wherein the speech coder is operable to perform the use and control in a single turn.

13. The electronic circuit of claim 1 wherein the speech coder is operable to generate contributions as the difference in cost function with the set of estimated pulse positions included and the cost function with fewer estimated pulse positions included.

14. The electronic circuit of claim 13 wherein the cost function with fewer estimated pulse positions has one fewer estimated pulse positions included.

15. The electronic circuit of claim 13 wherein the cost function with fewer estimated pulse positions has one pair fewer estimated pulse positions included.

16. The electronic circuit of claim 13 wherein using the cost function includes using a cost function that increases as the difference decreases.

17. The electronic circuit of claim 13 wherein the speech coder is operable to use the cost function to find the first subset of the tracks by identification of a higher value of cost function value in a set of cost function values respectively for at least the first and second subsets.

18. The electronic circuit of claim 1 wherein the speech coder is operable, for voiced stationary frames, to provide a single pulse search of each of a set of pulses, identify a subset of the pulses wherein each pulse in the subset has a lower contribution to the cost function than any other track outside the subset in the set of tracks, rank each track in the subset in order from least to more contribution to the cost function, pair the tracks in the subset in order of the ranking, and search the tracks jointly and successively in the pairs in order of the ranking from least to more contribution to the cost function.

19. The electronic circuit of claim 18 wherein the set of tracks has eight tracks.

20. The electronic circuit of claim 18 wherein the subset of tracks has six tracks and three pairs.

21. The electronic circuit of claim 1 wherein the speech coder is operable, for voiced non-stationary frames, to single-pulse search a plurality of sub-codebooks, generate a cost function value for the sub-codebooks as searched, select one sub-codebook that has the best cost function value of the sub-codebooks, and identify two pairs of tracks in the selected sub-codebook for the pulse positions that contribute least to the cost function in the single-pulse searching, and search each of those identified two pairs of tracks jointly thereby to select the pulse positions that maximize the cost function.

22. The electronic circuit of claim 21 wherein the speech coder is operable, in the single-pulse search, to at least temporarily retain the respective contributions to cost function by each of the tracks in the selected sub-codebook, rank the tracks by contribution, search the lowest-contribution two tracks jointly thereby to select the pulse positions that maximize the cost function, and then search the next lowest-contribution two tracks jointly thereby to select the pulse positions that maximize the cost function.

23. The electronic circuit of claim 1 wherein the speech coder is operable to use the cost function to find a particular subset including a second number of pulse tracks fewer in number than the first number wherein the particular subset of pulse tracks contributed less to the cost function than any other equally-numerous subset of the pulse tracks, and control a subsequent pulse position search beginning in order with the estimated pulse tracks pertaining to the least-contributing subset of pulse tracks, and refine the estimated pulse positions in at least one pair of pulse tracks having the two least-contributing pulse positions.

24. The electronic circuit of claim 23 wherein the speech coder is operable to refine by search beginning with the estimated pulse positions pertaining to the least-contributing pair of pulse tracks to yield refined estimated pulse positions of the particular subset of pulses.

25. The electronic circuit of claim 1 wherein the speech coder is operable to single-pulse position search to obtain the estimated pulse positions.

26. The electronic circuit of claim 25 wherein the single-pulse position search is a one turn search.

27. The electronic circuit of claim 25 wherein the speech coder is operable to predetermine one sub-codebook for the single-pulse position search.

28. The electronic circuit of claim 25 wherein the speech coder is operable to process different types of speech in frames and divide the frames into different numbers of subframes depending on the different types of speech, and further dynamically predetermine prior to the single-pulse search, one sub-codebook chosen from a plurality of sub-codebooks depending on the number of subframes per frame used for a type of speech.

29. The electronic circuit of claim 25 wherein the speech coder is operable to choose one sub-codebook from a plurality of sub-codebooks by single-pulse search of each of the plurality of sub-codebooks to yield estimated pulse positions, identify which one of the respective sub-codebooks provides a best value of cost function to obtain the estimated pulse positions provided from the sub-codebook thus identified.

30. A wireless communications unit comprising a wireless antenna;

a wireless transmitter and receiver coupled to said wireless antenna;

a speech input circuit for converting first audible speech into a first electrical form;

a speech output circuit for converting a second electrical form into second audible speech;

a microprocessor coupled to the transmitter and receiver, and further coupled to the speech input circuit and to the speech output circuit, the microprocessor having a storage and operable as a speech coder for approximating speech by pulses having pulse positions selectable from a codebook, the microprocessor operable to obtain a set of estimated pulse positions from the codebook having a first number of pulse tracks of the estimated pulse positions, use a cost function relating to approximation to speech to find a first subset including a second number of one or more pulse tracks fewer in number than the first number wherein the first subset of pulse tracks contributed a lower contribution to the cost function relative to a second subset of pulse tracks, and control a subsequent pulse position search beginning with the lower-contributing subset of pulse tracks to yield second pulse positions to provide a value of the cost function representing a better approximation to speech, and supply a coding of speech that depends on the second pulse positions to the wireless transmitter; and the microprocessor further operable as a speech decoder to correspondingly process coded speech of a type coded as aforesaid received by the wireless receiver so as to decode the coding of speech into the second electrical form and couple to the speech output circuit.

31. Operating an electronic device in speech coding for approximating speech by pulses having pulse positions selectable from a codebook stored in an electronically-readable medium, a process of codebook search comprising operating the electronic device to perform the steps of:

obtaining from the codebook a set of estimated pulse positions having a first number of pulse tracks of the estimated pulse positions;

using a cost function relating to approximation to speech to find a first subset including a second number of one or more pulse tracks fewer in number than the first number wherein the first subset of pulse tracks contributed a lower contribution to the cost function relative to a second subset of pulse tracks; and controlling a subsequent pulse position search beginning with the lower-contributing subset of pulse tracks to yield pulse positions to provide a value of the cost function representing a better approximation to speech.

* * * * *